US010281856B2

(12) United States Patent
Kojima

(10) Patent No.: US 10,281,856 B2
(45) Date of Patent: May 7, 2019

(54) IMAGE FORMING APPARATUS THAT SUPPRESSES INFLUENCE OF A HEATER TRIAC MALFUNCTION

(71) Applicant: Oki Data Corporation, Tokyo (JP)

(72) Inventor: Tomoyuki Kojima, Tokyo (JP)

(73) Assignee: Oki Data Corporatian, Tokyo (JP)

( * ) Notice: Subject to any disclaimer, the term of this patent is extended or adjusted under 35 U.S.C. 154(b) by 0 days.

(21) Appl. No.: 15/958,100

(22) Filed: Apr. 20, 2018

(65) Prior Publication Data

US 2018/0314196 A1 Nov. 1, 2018

(30) Foreign Application Priority Data

Apr. 27, 2017 (JP) ..... 2017-088343

(51) Int. Cl.
*G03G 15/20* (2006.01)
*G03G 15/08* (2006.01)
*G03G 15/00* (2006.01)

(52) U.S. Cl.
CPC ..... *G03G 15/2053* (2013.01); *G03G 15/0865* (2013.01); *G03G 15/2039* (2013.01); *G03G 15/2064* (2013.01); *G03G 15/55* (2013.01); *G03G 15/80* (2013.01)

(58) Field of Classification Search
CPC ..... G03G 15/2053; G03G 15/2064; G03G 15/2039
See application file for complete search history.

(56) References Cited

U.S. PATENT DOCUMENTS 5,350,900 A * 9/1994 Inage ..... G05B 9/02 219/481
5,756,969 A * 5/1998 Machino ..... G03G 15/2039 219/216
5,986,242 A * 11/1999 Maitani ..... G03G 15/2003 219/501
6,222,158 B1 * 4/2001 Nakata ..... G03G 15/2003 219/216
2007/0116502 A1 * 5/2007 Shimizu ..... G03G 15/2064 399/329
2009/0252521 A1 * 10/2009 Takami ..... G03G 15/80 399/69

(Continued)

FOREIGN PATENT DOCUMENTS

JP 2003-131516 A 5/2003

*Primary Examiner* — G. M. A Hyder
(74) *Attorney, Agent, or Firm* — Panitch Schwarze Belisario & Nadel LLP

(57) ABSTRACT

An image forming apparatus includes an image forming unit, first and second power terminals both coupled to a power supply, a fixing unit including a heater, a first switch, a first detector, a second switch, and a controller. The first switch includes a triac and is turned on and off on the basis of a first control signal. The first detector generates a first detection signal corresponding to the turning on and off of the first switch. The second switch includes a relay and is turned on and off on the basis of a second control signal. The controller generates the first control signal, and generates, on the basis of the first detection signal, the second control signal. Each of the heater, the first switch, and the second switch is provided in a power supply path that couples the first power terminal and the second terminal to each other.

16 Claims, 25 Drawing Sheets

(56) References Cited

U.S. PATENT DOCUMENTS

| | | | | |
|---|---|---|---|---|
| 2011/0268460 | A1* | 11/2011 | Odate | G03G 15/2039 399/33 |
| 2012/0141150 | A1* | 6/2012 | Noh | G03G 15/2039 399/33 |
| 2014/0044447 | A1* | 2/2014 | Jeong | G03G 15/80 399/69 |

* cited by examiner

IMAGE FORMING APPARATUS THAT SUPPRESSES INFLUENCE OF A HEATER TRIAC MALFUNCTION

CROSS REFERENCE TO RELATED APPLICATIONS

The present application claims priority from Japanese Patent Application No. 2017-088343 filed on Apr. 27, 2017, the entire contents of which are hereby incorporated by reference.

BACKGROUND

The technology relates to an image forming apparatus that forms an image on a recording medium.

An image forming apparatus may form a toner image, transfer the toner image onto a recording medium, and fix the transferred toner image to the recording medium, for example. A heater used in performing the foregoing fixing operation may be energized through turning on and off of a triac, for example, as disclosed in Japanese Unexamined Patent Application Publication No. 2003-131516.

SUMMARY

A triac may be possibly turned on due to a malfunction. What is therefore expected is to suppress an influence of a malfunction even when the malfunction of the triac occurs in an image forming apparatus.

It is desirable to provide an image forming apparatus that is able to suppress an influence of a malfunction of a triac.

According to one embodiment of the technology, there is provided an image forming apparatus that includes an image forming unit, a first power terminal, a second power terminal, a fixing unit, a first switch, a first detector, a second switch, and a controller. The image forming unit forms a developer image. The first power terminal and the second power terminal are both coupled to a power supply. The fixing unit includes a heater and fixes the developer image to a recording medium. The heater is provided in a power supply path that couples the first power terminal and the second power terminal to each other. The first switch includes a triac and is provided in the power supply path. The first switch is turned on and off on the basis of a first control signal. The first detector generates a first detection signal corresponding to the turning on and off of the first switch. The second switch includes a relay and is provided in the power supply path. The second switch is turned on and off on the basis of a second control signal. The controller generates the first control signal, and generates, on the basis of the first detection signal, the second control signal.

DETAILED DESCRIPTION

Figure 1:
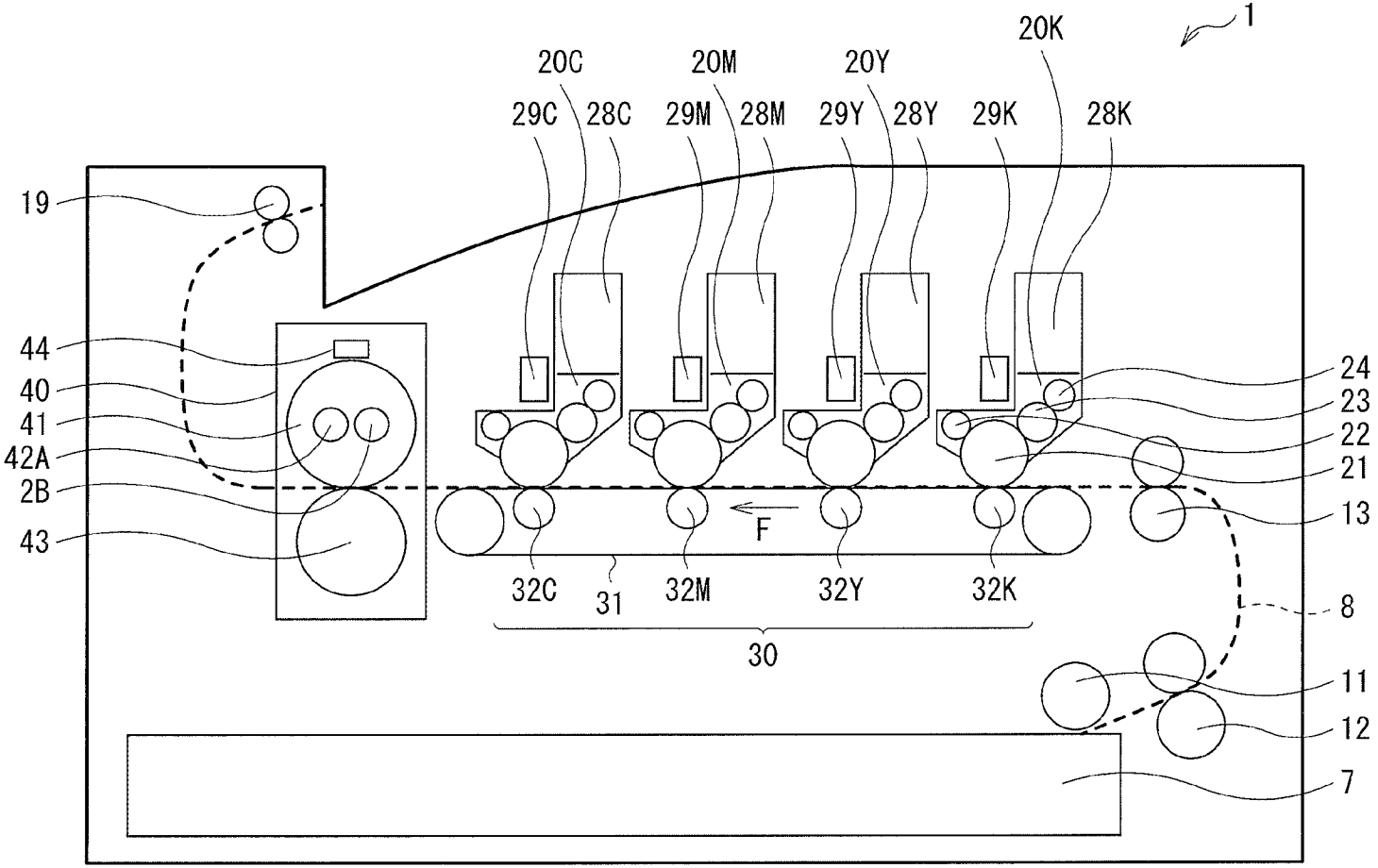
FIG. 1 is a configuration diagram illustrating an example of a configuration of an image forming apparatus according to one example embodiment of the technology.

Some example embodiments of the technology are described below in detail in the following order with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. First Example Embodiment
2. Second Example Embodiment
3. Third Example Embodiment
4. Fourth Example Embodiment

[1. First Example Embodiment]

[Configuration Example]

FIG. 1 illustrates an example of a configuration of an image forming apparatus (an image forming apparatus 1) according to a first example embodiment of the technology. The image forming apparatus 1 may serve as a printer that forms an image on a recording medium by an electrophotographic scheme, for example. Non-limiting examples of the recording medium may include plain paper.

The image forming apparatus 1 may include a pickup roller 11 a conveying roller 12, a registration roller 13, four image forming units 20, i.e., image forming units 20K, 20Y, 20M, and 20C, four toner containers 28, i.e., toner containers 28K, 28Y, 28M, and 28C, four exposure units 29, i.e., four exposure units 29K, 29Y, 29M, and 29C, a transfer unit 30, a fixing unit 40, and a discharging roller 19. The foregoing members may be disposed along a conveyance path 8 along which a recording medium 9 is conveyed.

The pickup roller 11 may pick up the recording medium 9 contained in a medium container 7 one by one from the top, and feed the picked -up recording medium 9 to the conveyance path 8.

The conveying roller 12 may include a pair of rollers with the conveyance path 8 in between. The conveying roller 12 may convey, along the conveyance path 8, the recording medium 9 that has been picked up by the pickup roller 11.

The registration roller 13 may include a pair of rollers with the conveyance path 8 in between. The registration roller 13 may correct a skew of the recording medium 9, and guide, along the conveyance path 8, the recording medium 9 toward the four image forming units 20.

The four image forming units 20 may each form a toner image. For example, the image forming unit 20K may form a black toner image. The image forming unit 20Y may form a yellow toner image. The image forming unit 20M may form a magenta toner image. The image forming unit 20C may form a cyan toner image. The image forming units 20K, 20Y, 20M, and 20C may be disposed in this order in a conveyance direction F of the recording medium 9. The conveyance direction F may be a direction in which the recording medium 9 is conveyed.

The four image forming units 20 may each include a photosensitive member 21, a charging roller 22, a developing roller 23, and a feeding roller 24.

The photosensitive member 21 may have a surface (a surficial part) that supports an electrostatic latent image. The photosensitive member 21 may be rotated by power transmitted from an unillustrated photosensitive member motor. In one example, the photosensitive member 21 may be rotated clockwise. The photosensitive member 21 may be electrically charged by the charging roller 22, and be subjected to exposure by the exposure unit 29. The electrostatic latent image may be thereby formed on the surface of the photosensitive member 21. Further, the toner may be fed by the developing roller 23 to the photosensitive member 21. A toner image in accordance with the electrostatic latent image may be thereby formed on the photosensitive member 21. In other words, the toner image in accordance with the electrostatic latent image may be thereby developed on the photosensitive member 21.

The charging roller 22 may electrically charge the surface (the surficial part) of the photosensitive member 21. The charging roller 22 may be disposed in contact with a surface (a circumferential surface) of the photosensitive member 21, and pressed against the photosensitive member 21 by a predetermined pressing amount. The charging roller 22 may be rotated in accordance with the rotation of the photosensitive member 21. In one example, the charging roller 22 may be rotated counterclockwise. The charging roller 22 may receive a predetermined charging voltage from a high-voltage power supply unit 58 which will be described later.

The developing roller 23 may have a surface that supports the electrically-charged toner. The developing roller 23 may be disposed in contact with the surface (the circumferential surface) of the photosensitive member 21, and pressed against the photosensitive member 21 by a predetermined pressing amount. The developing roller 23 may be rotated by power transmitted from an unillustrated photosensitive member motor. In one example, the developing roller 23 may be rotated counterclockwise. The developing roller 23 may receive a predetermined development voltage from the high-voltage power supply unit 58 which will be described later.

The feeding roller 24 may feed, to the developing roller 23, the toner stored in the toner container 28. The feeding roller 24 may be disposed in contact with a surface (a circumferential surface) of the developing roller 23, and pressed against the developing roller 23 by a predetermined pressing amount. The feeding roller 24 may be rotated by power transmitted from an unillustrated photosensitive member motor. In one example, the feeding roller 24 may be rotated counterclockwise. This may generate friction between the surface of the feeding roller 24 and the surface of the developing roller 23. As a result, the toner may be electrically charged by so-called frictional electrification. The feeding roller 24 may receive a predetermined feeding voltage from the high-voltage power supply unit 58 which will be described later.

The four toner containers 28 may each store the toner. For example, the toner container 28K may store a black toner. The toner container 28Y may store a yellow toner. The toner container 28M may store a magenta toner. The toner container 28C may store a cyan toner. In one example, the four toner containers 28 may be configured to be separable from corresponding one of the image forming units 20.

The four exposure units 29 may each apply light to the photosensitive member 21 of corresponding one of the four image forming units 20. The four exposure units 29 may each include a light-emitting diode (LED) head, for example. For example, the exposure unit 29K may apply light to the photosensitive member 21 of the image forming unit 20K. The exposure unit 29Y may apply light to the photosensitive member 21 of the image forming unit 20Y. The exposure unit 29M may apply light to the photosensitive member 21 of the image forming unit 20M. The exposure unit 29C may apply light to the photosensitive member 21 of the image forming unit 20C. Each of the photosensitive members 21 may be thus subjected to exposure by corresponding one of the exposure units 29. As a result, the electrostatic latent image may be formed on the surface of each of the photosensitive members 21.

The transfer unit 30 may transfer, onto a transfer target surface of the recording medium 9, the toner images formed by the respective four image forming units 20K, 20Y, 20M, and 20C. The transfer target surface may be a surface, of the recording medium 9, onto which the toner image is to be transferred.

The transfer unit 30 may include a transfer belt 31 and four transfer rollers 32, i.e., transfer rollers 32K, 32Y, 32M, and 32C. The transfer belt 31 may convey the recording medium 9 in the conveyance direction F along the conveyance path 8. For example, the transfer roller 32K may face the photosensitive member 21 of the image forming unit 20K with the conveyance path 8 and the transfer belt 31 in between. The transfer roller 32Y may face the photosensitive member 21 of the image forming unit 20Y with the conveyance path 8 and the transfer belt 31 in between. The transfer roller 32M may face the photosensitive member 21 of the image forming unit 20M with the conveyance path 8 and the transfer belt 31 in between. The transfer roller 32C may face the photosensitive member 21 of the image forming unit 20C with the conveyance path 8 and the transfer belt 31 in between. Each of the transfer rollers 32K, 32Y, 32M, and 32C may receive a predetermined transfer voltage from the high-voltage power supply unit 58 which will be described later. As a result, the toner images formed on the respective image forming units 20 may be transferred onto the transfer target surface of the recording medium 9, in the image forming apparatus 1.

The fixing unit 40 may apply heat and pressure to the recording medium 9, and thereby fix, to the recording medium 9, the toner image transferred onto the recording medium 9. The fixing unit 40 may include a heating roller 41, a pressure applying roller 43, and a temperature sensor 44. The heating roller 41 may apply heat to the toner on the recording medium 9. The heating roller 41 may include two heaters, i.e., a heater 42A and a heater 42B. The heaters 42A and 42B may each include, for example but not limited to, a halogen heater or a ceramic heater. The heaters 42A and 42B may each be selectively used, for example, depending on a factor such as a medium size or a thickness of the recording medium 9. The pressure applying roller 43 may be so disposed that a pressure-contact is provided between the pressure applying roller 43 and the heating roller 41. The pressure applying roller 43 may thus apply pressure to the toner on the recording medium 9. The temperature sensor 44 may detect a surface temperature of the heating roller 41. The temperature sensor 44 may include, for example but not limited to, a thermistor. In the foregoing manner, the toner on the recording medium 9 may be heated, melted, and applied with pressure in the fixing unit 40. As a result, the toner image may be fixed to the recording medium 9.

The discharging roller 19 may include a pair of rollers with the conveyance path 8 in between. The discharging roller 19 may discharge the recording medium 9 to outside of the image forming apparatus 1.

Figure 2:
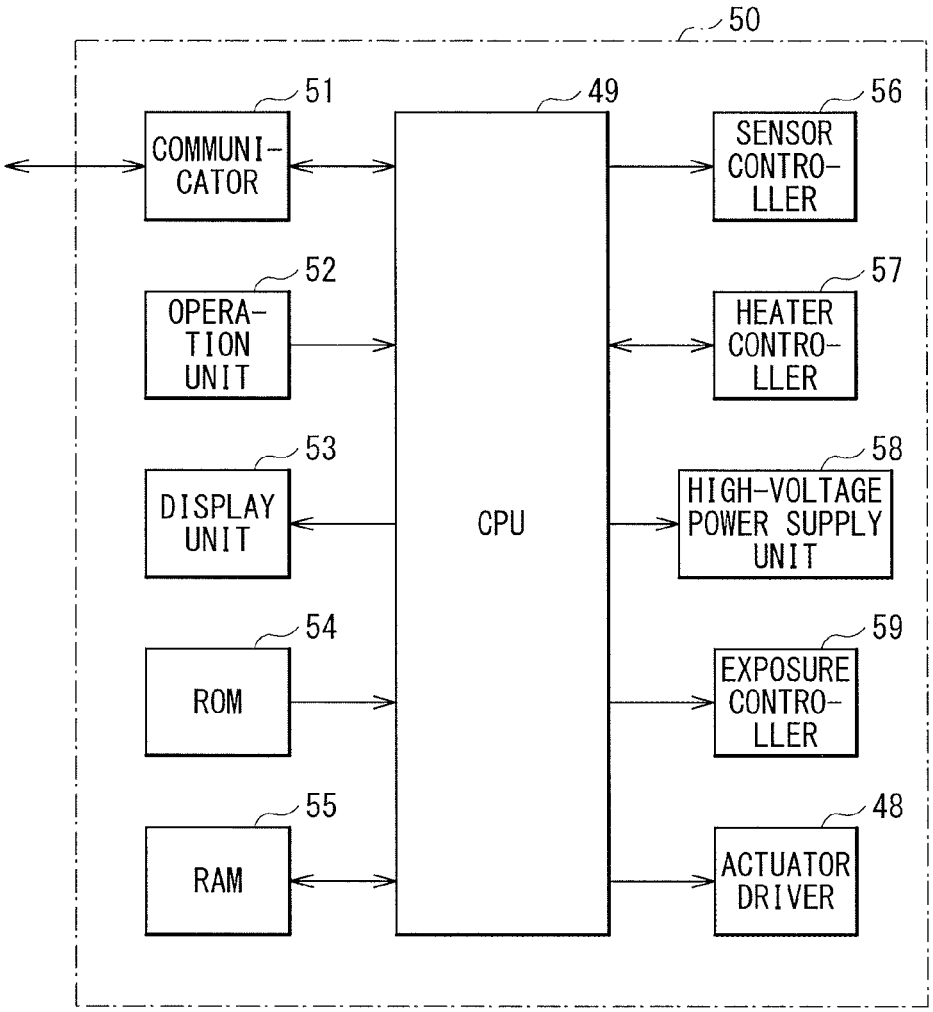
FIG. 2 is a block diagram illustrating an example of a configuration of a controller of the image forming apparatus illustrated in FIG. 1.
Figure 3:
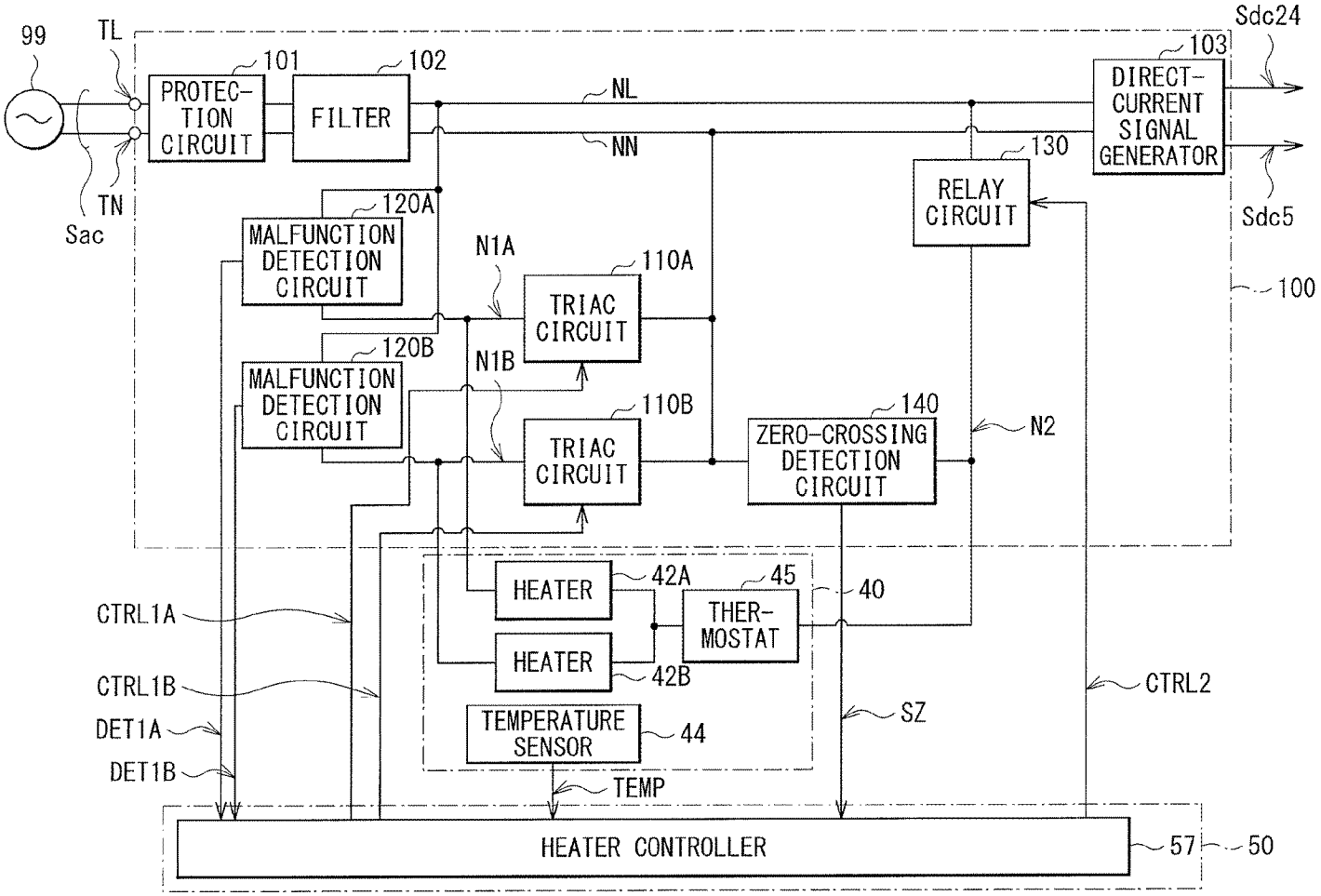
FIG. 3 is a block diagram illustrating an example of a configuration of a power supply unit according to one example embodiment of the technology.

FIGS. 2 and 3 illustrate an example of a control mechanism of the image forming apparatus 1. The image forming apparatus 1 may include a controller 50 and a power supply unit 100. FIG. 3 also illustrates the fixing unit 40. The fixing unit 40 may include a thermostat 45 that protects the heaters 42A and 42B.

The controller 50 may include a communicator 51, an operation unit 52, a display unit 53, a read-only memory (ROM) 54, a random access memory (RAM) 55, a sensor controller 56, a heater controller 57 the high-voltage power supply unit 58, an exposure controller 59, an actuator driver 48, and a central processing unit (CPU) 49.

The communicator 51 may perform communication by means of, for example but not limited to, a universal serial bus (USB) or a local area network (LAN). The communicator 51 may receive print data DP supplied from an unillustrated host computer, for example. The operation unit 52 may receive an operation performed by a user. The operation unit 52 may include, for example but not limited to, various buttons or a touch panel. The display unit 53 may display content such as an operation state of the image forming apparatus 1. The display unit 53 may include, for example but not limited to, a liquid crystal display or various indicators. The ROM 54 may be a non-volatile memory, and store various programs to be executed by the CPU 49. The RAM 55 may be a volatile memory, and serve as a temporary storage area. The sensor controller 56 may control operations of various sensors provided to the image forming apparatus 1. For example, the image forming apparatus 1 may be provided with various unillustrated sensors such as a sensor that detects a position of the recording medium 9 on the conveyance path 8, a sensor that detects a concentration of an image, or a sensor directed to correction of color deviation. The sensor controller 56 may control the operations of the sensors described above, for example.

The heater controller 57 may control operations of the respective heaters 42A and 42B of the fixing unit 40. For example, the heater controller 57 may generate a triac control signal CTRL1A, a triac control signal CTRL1B, and a relay control signal CTRL2 on the basis of a zero-crossing signal SZ, a detection signal DET1A, a detection signal DET1B, and a temperature detection signal TEMP, and thereby control the operations of the respective heaters 42A and 42B. The temperature detection signal TEMP may be supplied to the heater controller 57 from the temperature sensor 44 of the fixing unit 40.

The high-voltage power supply unit 58 may generate various high voltages that are used in the image forming apparatus 1. For example, the high-voltage power supply unit 58 may generate high voltages such as the charging voltage, the development voltage, the feeding voltage, or the transfer voltage. The exposure controller 59 may control the operations of the respective four exposure units 29. The actuator driver 48 may drive actuators that are provided in the image forming apparatus 1. For example, the actuator driver 48 may drive actuators such as various motors, a clutch, a solenoid, or a cooling fan.

The CPU 49 may execute various programs, and control operations of the respective blocks in the image forming apparatus 1 on the basis of results of the execution of the various programs. The CPU 49 may thereby control a general operation of the image forming apparatus 1.

As illustrated in FIG. 3 the power supply unit 100 may include a protection circuit 101, a filter 102, a direct-current signal generator 103, a triac circuit 110A, a triac circuit 110B, a malfunction detection circuit 120A, a malfunction detection circuit 120B, a relay circuit 130, and a zero-crossing detection circuit 140. The power supply unit 100 may include a power terminal TL and a power terminal TN, and coupled to a commercial power supply 99 via the power terminals TL and TN. The power terminal TL may be a so-called line terminal. The power terminal TN may be a so-called neutral terminal. The power supply unit 100 may thus receive an alternate-current power supply signal Sac from the commercial power supply 99.

The protection circuit 101 may include, for example but not limited to, a fuse against overcurrent or a varistor against lightning surge. The filter 102 may include, for example but not limited to, a capacitor and one of a common-mode choke coil and a choke coil. The protection circuit 101 and the filter 102 may be provided in this order on a path leading from the power terminals TL and TN to nodes NL and NN. The node NL may correspond to the power terminal TL, i.e., the line terminal, and the node NN may correspond to the power terminal TN, i.e., the neutral terminal. Accordingly, the power supply signal Sac may appear in the respective nodes NL and NN.

The direct-current signal generator 103 may be coupled to the respective nodes NL and NN, and thus generate, on the basis of the power supply signal Sac, a direct-current signal Sdc24 of 24 V and a direct-current signal Sdc5 of 5 V. The direct-current signal generator 103 may include a rectifier circuit, a smoothing circuit, and a DC-DC converter circuit, for example. The rectifier circuit may include a plurality of diodes, for example. In one example, the rectifier circuit may include a so-called bridge diode. The smoothing circuit may include an electrolytic capacitor, for example. Further, the direct-current signal generator 103 may further include a circuit directed to suppression of an inrush current upon turning on of the power supply, for example. In one example, the direct-current signal Sdc24 of 24 V may be supplied to the actuators, such as the various motors, the clutch, the solenoid, or the cooling fan, that are provided in the image forming apparatus 1. In one example, the direct-current signal Sdc5 of 5 V may be supplied to the controller 50 as a power supply voltage.

It is to be noted that the generation of the direct-current signal and the supply of the generated direct-current signal are not limited to those described above. In one example, the direct-current signal generator 103 may generate a direct-current signal having a voltage that is lower than 5 V, e.g., a direct-current signal of 3.3 V, and supply the generated direct-current signal to the controller 50 as the power supply voltage. In another example, the controller 50 may generate, on the basis of the direct-current signal Sdc5 of 5 V or the direct-current signal Sdc24 of 24 V, a direct-current signal having a lower voltage, e.g., a direct-current signal of 3.3 V, and use the generated direct-current signal as the power supply voltage.

The triac circuit 110A may include a triac, and be turned on and off on the basis of the triac control signal CTRL1A. The triac circuit 110A may be inserted between the node NN and a node N1A. The node N1A may be coupled to a first terminal of the heater 42A of the fixing unit 40.

The triac circuit 110B may include a triac, and be turned on and off on the basis of the triac control signal CTRL1B. The triac circuit 110B may be inserted between the node NN and a node N1B. The node N1B may be coupled to a first terminal of the heater 42B of the fixing unit 40.

The malfunction detection circuit 120A may output a signal corresponding to turning on and off of a triac 115 in the triac circuit 110A which will be described later, i.e., the detection signal DET1A. The malfunction detection circuit 120A may be inserted between the node N1A and the node NL.

The malfunction detection circuit 120B may output a signal corresponding to turning on and off of a triac 115 in the triac circuit 110B which will be described later, i.e., the detection signal DET1B. The malfunction detection circuit 120B may be inserted between the node N1B and the node NL.

The relay circuit 130 may include a relay, and be turned on and off on the basis of the relay control signal CTRL2. The relay circuit 130 may be inserted between a node N2 and the node NL. The node N2 may be coupled to both of a second terminal of the heater 42A and a second terminal of the heater 42B with the thermostat 45 in between.

The zero-crossing detection circuit 140 may generate the zero-crossing signal SZ by generating, on the basis of the power supply signal Sac, a pulse near so-called zero-crossing timing at which zero-crossing occurs. The zero-crossing detection circuit 140 may be inserted between the node NN and the node N2.

In the above-described example, the zero-crossing detection circuit 140 may be coupled to the node N2. The zero-crossing detection circuit 140 may be therefore prevented from operating when the relay circuit 130 is turned off. This achieves reduction in power consumption. It is to be noted that the position of the zero-crossing detection circuit 140 is not limited to the example position described above. In another example, the zero-crossing detection circuit 140 may be inserted between the node NN and the node NL. In this example case, the zero-crossing detection circuit 140 may be able to operate also when the relay circuit 130 is turned off. This makes it possible to detect, for example, supply of the power supply signal Sac.

The above-described configuration may allow heating of the heater 42A as a result of the turning on of both the triac circuit 110A and the relay circuit 130 in the image forming apparatus 1. The above-described configuration may also allow, in a similar manner, heating of the heater 42B as a result of the turning on of both the triac circuit 110B and the relay circuit 130 in the image forming apparatus 1.

Figure 4:
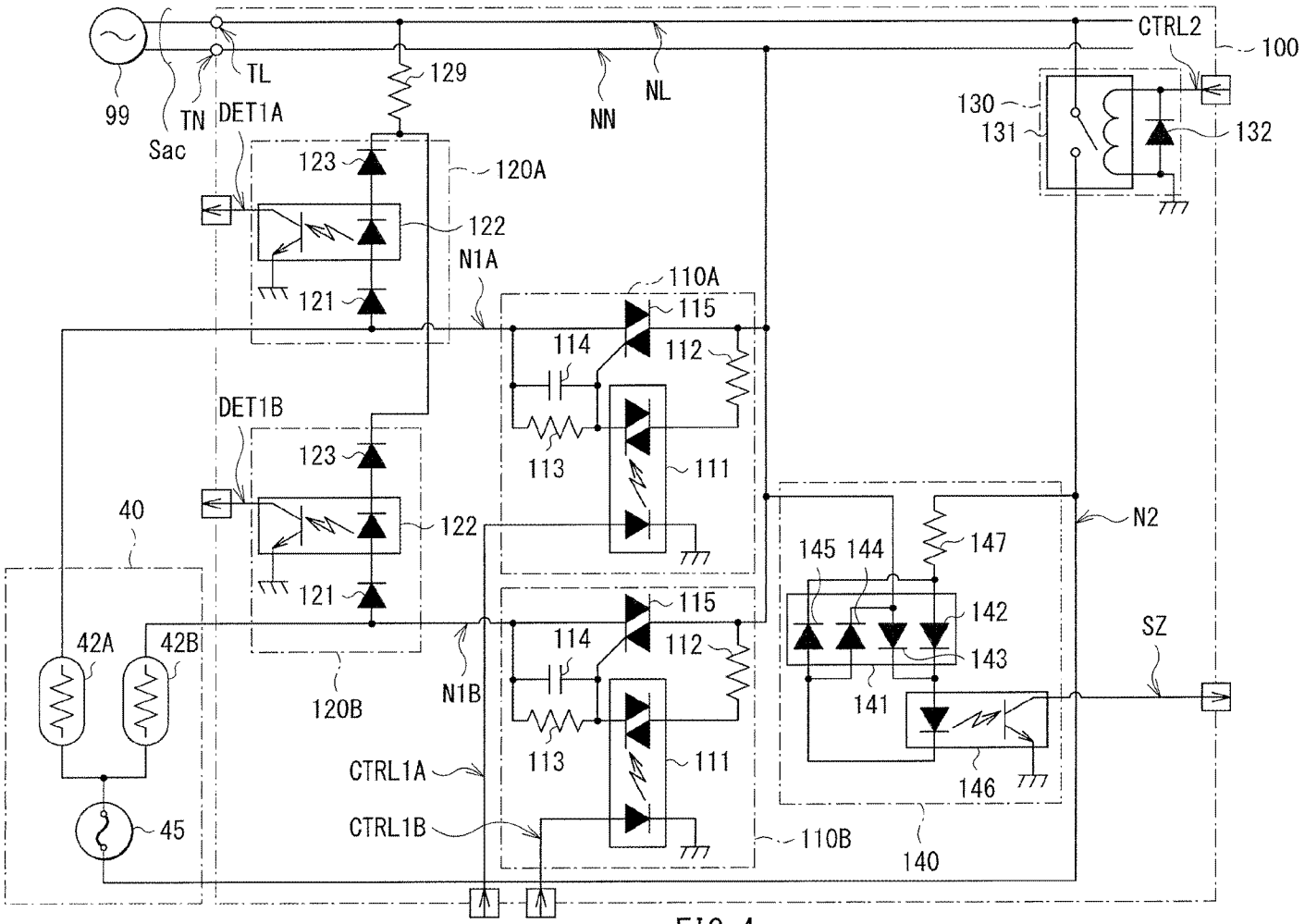
FIG. 4 is a circuit diagram illustrating an example of a configuration of the power supply unit illustrated in FIG. 3.

FIG. 4 illustrates an example of a configuration of a main part of the power supply unit 100. FIG. 4 illustrates the triac circuits 110A and 110B, the malfunction detection circuits 120A and 120B, the relay circuit 130, and the zero-crossing detection circuit 140 together with the heaters 42A and 42B and the thermostat 45 of the fixing unit 40.

The triac circuit 110A may include a phototriac coupler 111, a resistor 112, a resistor 113, a capacitor 114, and the triac 115. The phototriac coupler 111 may include a light-emitting diode having an anode that receives the triac control signal CTRL1A, and a cathode that is grounded. It is to be noted, however, that the configuration of the phototriac coupler 111 is not limited to the configuration described above. In one example, the cathode of the light-emitting diode of the phototriac coupler 111 may also receive a control signal. The phototriac coupler 111 may include a phototriac having a first terminal that is coupled to a second terminal of the resistor 112, and having a second terminal that is coupled to each of a first terminal of the resistor 113, a first terminal of the capacitor 114, and a control terminal of the triac 115. The resistor 112 may have a first terminal that is coupled to the node NN, and have the second terminal that is coupled to the first terminal of the phototriac of the phototriac coupler 111. The resistor 113 may have the first terminal that is coupled to each of the first terminal of the phototriac of the phototriac coupler 111, the first terminal of the capacitor 114, and the control terminal of the triac, and have a second terminal that is coupled to the node N1A. The capacitor 114 may have the first terminal that is coupled to each of the second terminal of the phototriac of the phototriac coupler 111, the first terminal of the resistor 113, and the control terminal of the triac 115, and have a second terminal that is coupled to the node N1A. The triac 115 may have the control terminal that is coupled to each of the second terminal of the phototriac of the phototriac coupler 111, the first terminal of the resistor 113, and the first terminal of the capacitor 114. The triac 115 may further have a first terminal that is coupled to the node NN, and have a second terminal that is coupled to the node N1A.

The triac circuit 110B may have a configuration similar to that of the triac circuit 110A, and therefore include the phototriac coupler 111, the resistor 112, the resistor 113, the capacitor 114, and the triac 115. In the triac circuit 110B, however, the anode of the light-emitting diode of the phototriac coupler 111 may receive the triac control signal CTRL1B. The first terminal of the resistor 112 and the first terminal of the triac 115 may be both coupled to the node NN. Each of the second terminal of the resistor 113, the second terminal of the capacitor 114, and the second terminal of the triac 115 may be coupled to the node N1B.

The malfunction detection circuit 120A may include a diode 121, a photocoupler 122, and a diode 123. The diode 121 may have an anode that is coupled to the node N1A, and have a cathode that is coupled to an anode of a light-emitting diode of the photocoupler 122. The photocoupler 122 may include the light-emitting diode having the anode that is coupled to the cathode of the diode 121, and having a cathode that is coupled to an anode of the diode 123. The photocoupler 122 may include a phototransistor having a collector that outputs the detection signal DET1A, and having an emitter that is grounded. An input terminal, of the heater controller 57, to which the detection signal DET1A is supplied may be provided with a pull-up resistor. The diode 123 may have the anode that is coupled to the cathode of the light-emitting diode of the photocoupler 122, and have a cathode that is coupled to the node NL with a resistor 129 in between. It is to be noted that, although the above-described malfunction detection circuit 120A may be provided with the two diodes 121 and 123, the configuration of the malfunction detection circuit 120A is not limited thereto. In one example, provision of one of the two diodes 121 and 123 may be omitted.

With this configuration, in the malfunction detection circuit 120A, on a condition that the triac 115 of the triac circuit 110A is turned on, a current may flow from the node N1A toward the node NL via the diode 121, the photocoupler 122, and the diode 123, and the detection signal DET1A may be thereby caused to be at a low level, when a voltage at the node N1A (the node NN) is higher than a voltage at the node NL. When the voltage at the node N1A (the node NN) is lower than the voltage at the node NL, a current may be prevented from flowing through the malfunction detection circuit 120A, which may cause the detection signal DET1A to be at a high level. In such a manner, the malfunction detection circuit 120A may cause, when the triac 115 of the triac circuit 110A is turned on, the detection signal DET1A to be at the low level in a period corresponding to a half cycle of the alternate-current power supply signal Sac.

The malfunction detection circuit 120B may have a configuration similar to that of the malfunction detection circuit 120A, and therefore include the diode 121, the photocoupler 122, and the diode 123. In the malfunction detection circuit 120B, however, the anode of the diode 121 may be coupled to the node N1B. The collector of the phototransistor of the photocoupler 122 may output the detection signal DET1B. An input terminal, of the heater controller 57, to which the detection signal DET1B is supplied may be provided with a pull-up resistor. The cathode of the diode 123 may be coupled to the node NL with the resistor 129 in between.

This configuration may cause the malfunction detection circuit 120B to cause, when the triac 115 of the triac circuit 110B is turned on, the detection signal DET1B to be at a high level in a period corresponding to a half cycle of the alternate-current power supply signal Sac.

The relay circuit 130 may include a relay 131 and a diode 132. The relay 131 may include a coil having a first terminal that receives the relay control signal CTRL2 and having a second terminal that is grounded. It is to be noted that the configuration of the relay 131 is not limited to the configuration described above. In one example, the second terminal of the coil of the relay 131 may also receive a control signal. The relay 131 may include a switch having a first terminal that is coupled to the node N2 and a second terminal that is coupled to the node NL. The diode 132 may have an anode that is coupled to the second terminal of the coil of the relay 131, and have a cathode that is coupled to the first terminal of the coil of the relay 131. The diode 132 may be directed to protection of a circuit such as the heater controller 57 from counter-electromotive force generated by the coil of the relay 131.

The zero-crossing detection circuit 140 may include a rectifier diode circuit 141, a photocoupler 146, and a resistor 147. The rectifier diode circuit 141 may include four diodes, i.e., diodes 142, 143, 144, and 145. The diode 142 may have an anode that is coupled to both a cathode of the diode 145 and a first terminal of the resistor 147, and have a cathode that is coupled to both a cathode of the diode 143 and an anode of a light-emitting diode of the photocoupler 146. The diode 143 may have an anode that is coupled to the node NN, and have the cathode that is coupled to both the cathode of the diode 142 and the anode of the light-emitting diode of the photocoupler 146. The diode 144 may have an anode that is coupled to both an anode of the diode 145 and a cathode of the light-emitting diode of the photocoupler 146, and have a cathode that is coupled to the node NN. The diode 145 may have the anode that is coupled to both the anode of the diode 144 and the cathode of the light-emitting diode of the photocoupler 146, and have the cathode that is coupled to both the anode of the diode 142 and the first terminal of the resistor 147. The photocoupler 146 may include the light-emitting diode having the anode that is coupled to both the cathode of the diode 142 of the rectifier diode circuit 141 and the cathode of the diode 143 of the rectifier diode circuit 141, and having the cathode that is coupled to both the anode of the diode 144 of the rectifier diode circuit 141 and the anode of the diode 145 of the rectifier diode circuit 141. The photocoupler 146 may include a phototransistor having a collector that outputs the zero-crossing signal SZ, and having a cathode that is grounded. An input terminal, of the heater controller 57, to which the zero-crossing signal SZ is supplied may be provided with a pull-up resistor. The resistor 147 may have the first terminal that is coupled to both the anode of the diode 142 of the rectifier diode circuit 141 and the cathode of the diode 145, and have a second terminal that is coupled to the node N2.

This configuration may allow the zero-crossing detection circuit 140 to rectify the alternate-current power supply signal Sac. For example, in the zero-crossing detection circuit 140, on a condition that the relay 131 of the relay circuit 130 is turned on, a current may flow from the node N2 toward the node NN via the resistor 147, the diode 142, the photocoupler 146, and the diode 144, and the zero-crossing signal SZ may be thereby caused to be at a low level, when a voltage at the node N2 (the node NL) is higher than a voltage at the node NN. When the voltage at the node N2 (the node NL) is lower than the voltage at the node NN, a current may flow from the node NN toward the node N2 via the diode 143, the photocoupler 146, the diode 145, and the resistor 147, and the zero-crossing signal SZ may be thereby caused to be at a low level. When the voltage at the node N2 (the node NL) is substantially the same as the voltage at the node NN, a current may be prevented from flowing through the zero-crossing detection circuit 140, and the zero-crossing signal SZ may be thereby caused to be at a high level. In such a manner, the zero-crossing detection circuit 140 may cause the zero-crossing signal SZ to be at the high level near the so-called zero-crossing timing of the power supply signal Sac.

For example, the triac circuit 110A may correspond to a "first switch" in one specific but non-limiting embodiment of the technology. For example, the triac control signal CTRL1A may correspond to a "first control signal" in one specific but non-limiting embodiment of the technology. For example, the malfunction detection circuit 120A may correspond to a "first detector" in one specific but non-limiting embodiment of the technology. For example, the detection signal DET1A may correspond to a "first detection signal" in one specific but non-limiting embodiment of the technology. The relay circuit 130 may correspond to a "second switch" in one specific but non-limiting embodiment of the technology. The relay control signal CTRL2 may correspond to a "second control signal" in one specific but non-limiting embodiment of the technology. The heater controller 57 may correspond to a "controller" in one specific but non-limiting embodiment of the technology. The zero-crossing detection circuit 140 may correspond to a "synchronization signal generator" in one specific but non-limiting embodiment of the technology. One of the power terminal TN and the node NN may correspond to a "first power terminal" in one specific but non-limiting embodiment of the technology. One of the power terminal TL and the node NL may correspond to a "second power terminal" in one specific but non-limiting embodiment of the technology.

[Example Operations and Example Workings]

A description is given next of example operations and example workings of the image forming apparatus 1 according to the first example embodiment.

[Overview of General Operation]

A description is given first of an overview of a general operation of the image forming apparatus 1 with reference to FIGS. 1 and 2. In the image forming apparatus 1, the heater controller 57 may cause, when the communicator 51 receives the print data DP from the host computer, electric power to be fed to each of the heaters 42A and 42B of the fixing unit 40 on the basis of an instruction given from the CPU 49. When the surface temperature, of the heating roller 41, detected by the temperature sensor 44 reaches a temperature appropriate for the fixing operation, the CPU 49 may cause an image forming operation to be started.

In the image forming operation, first, the actuator driver 48 may cause, on the basis of an instruction given from the CPU 49, the pickup roller 11 to operate. The actuator driver 48 may also cause, on the basis of an instruction given from the CPU 49, both the conveying roller 12 and the registration roller 13 to operate. This may cause the recording medium 9 to be conveyed along the conveyance path 8.

Thereafter, the actuator driver 48 may cause each of the photosensitive members 21, the developing rollers 23, and the feeding rollers 24 in the four image forming units 20 to rotate by controlling unillustrated photosensitive member motor. Further, the actuator driver 48 may cause the transfer belt 31 to be conveyed circularly. The high-voltage power supply unit 58 may generate various high voltages to be used in the image forming apparatus 1 such as the charging voltage, the development voltage, the feeding voltage, or the transfer voltage. The exposure controller 59 may control an operation of each of the four exposure units 29. Thereby, the electrostatic latent image may be first formed on the surface of the photosensitive member 21 of each of the image forming units 20, and thereafter, the toner image may be formed in accordance with the formed electrostatic latent image. Thereafter, the toner image on the photosensitive member 21 of each of the image forming units 20 may be transferred onto the transfer target surface of the recording medium 9.

Thereafter, the actuator driver 48 may cause both the heating roller 41 and the pressure applying roller 43 to rotate. Thereby, the toner on the recording medium 9 may be heated, melted, and applied with pressure in the fixing unit 40. As a result, the toner image may be fixed to the recording medium 9. Thereafter, the actuator driver 48 may cause the discharging roller 19 to rotate. This may cause the recording medium 9 to which the toner is fixed to be discharged.

[Detailed Operation]

A detailed description is given next of a warm-up operation to be performed after the power is turned on. A normal operation is described first, and an example operation to be performed upon occurrence of a malfunction is described next.

Figure 5:
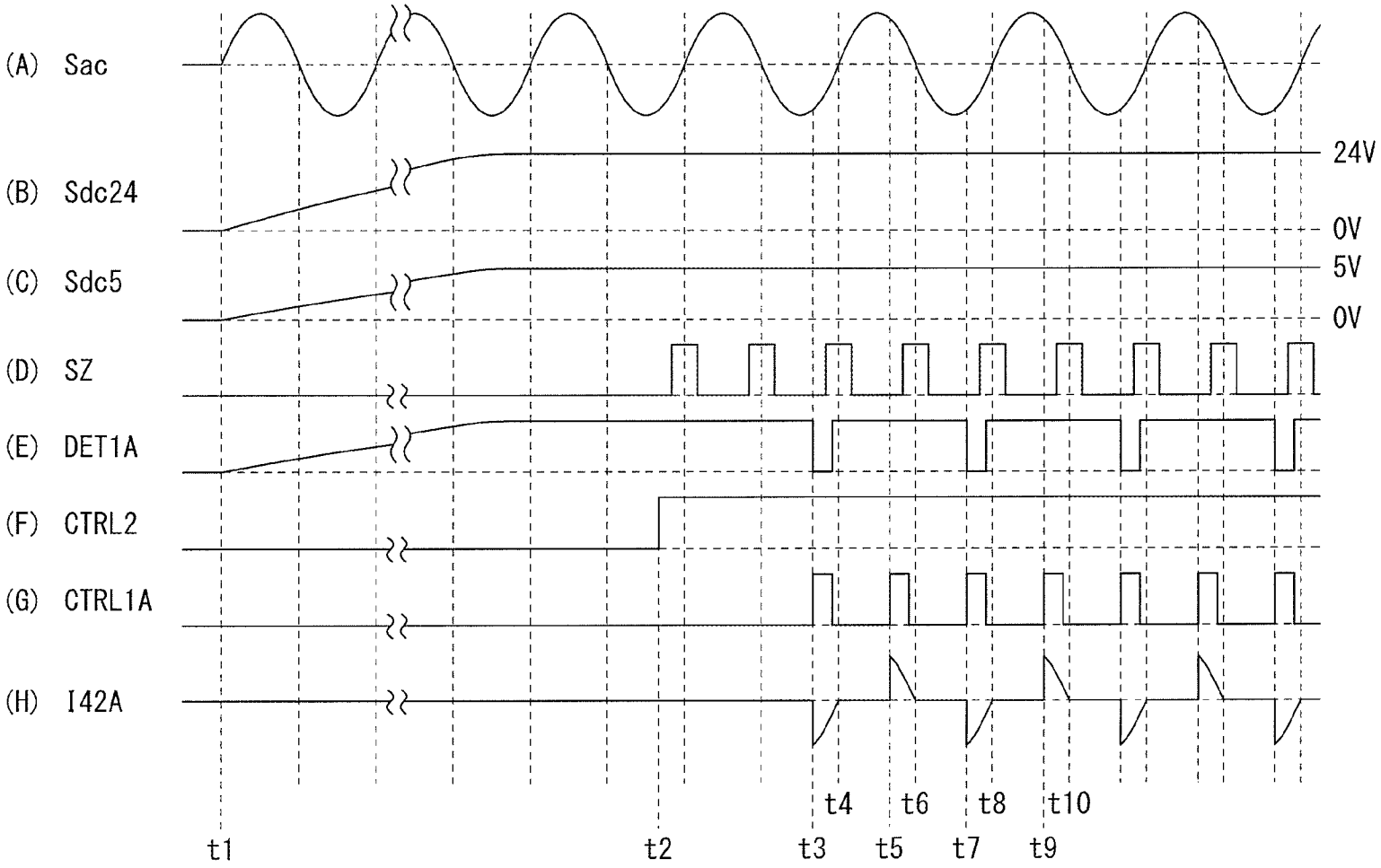
FIG. 5 is a timing waveform diagram illustrating an example of an operation of the power supply unit illustrated in FIG. 4.

FIG. 5 illustrates an example of an operation of the power supply unit 100. Part (A) illustrates a waveform of the power supply signal Sac, Part (B) illustrates a waveform of the direct-current signal Sdc24, Part (C) illustrates a waveform of the direct-current signal Sdc5, Part (D) illustrates a waveform of the zero-crossing signal SZ, Part (E) illustrates a waveform of the detection signal DET1A, Part (F) illustrates a waveform of the relay control signal CTRL2, Part (G) illustrates a waveform of the triad control signal CTRL1A, and Part (H) illustrates a waveform of a current that flows through the heater 42A, i.e., a heater current 142A. The waveform of the power supply signal Sac illustrated in Part (A) of FIG. 5 may be a waveform of a voltage as a result of subtracting the voltage at the node NN (neutral) from the voltage at the node NL (line). Although FIG. 5 illustrates by way of example only an operation related to the heater 42A, an operation related to the heater 42B may be similar to the operation related to the heater 42A.

First, at timing t1, the power supply unit 100 may receive the power supply signal Sac from the commercial power supply 99, as a result of the turning on of the power, as illustrated in Part (A) of FIG. 5. The direct-current signal generator 103 may generate the direct current signals Sdc24 and Sdc5 on the basis of the received power supply signal Sac. A voltage of the direct-current signal Sdc24 may be increased gradually toward 24 V, as illustrated in Part (B) of FIG. 5. A voltage of the direct-current signal Sdc5 may be increased gradually toward 5 V, as illustrated in Part (C) of FIG. 5. Thus, the voltage of the direct-current signal Sdc24 may reach about 24 V, and the voltage of the direct-current signal Sdc5 may reach about 5 V.

Thereafter, at timing t2, the heater controller 57 may vary the relay control signal CTRL2 from the low level to the high level, as illustrated in Part (F) of FIG. 5. This may turn on the relay 131 of the relay circuit 130, and therefore, the power supply signal Sac may be supplied to the zero-crossing detection circuit 140. Further, the zero-crossing detection circuit 140 may start generating the zero-crossing signal SZ at or after the timing t2, as illustrated in Part (D) of FIG. 5. The zero-crossing signal SZ may have a pulse width of, for example but not limited to, from about 1 msec to about 2 msec.

The heater controller 57 may generate the triac control signal CTRL1A on the basis of the zero-crossing signal SZ thus generated by the zero-crossing detection circuit 140, as illustrated in Part (G) of FIG. 5. For example, the heater controller 57 may sense a phase of the power supply signal Sac, with the use of two or more rising edges included in the zero-crossing signal SZ. FIG. 5 illustrates an example case where the heater controller 57 senses the phase of the power supply signal Sac with the use of two rising edges included in the zero-crossing signal SZ. However, edges to be used upon the sensing of the phase of the power supply signal Sac are not limited thereto. In one example, two or more falling edges included in the zero-crossing signal SZ may be used upon the recognition of the phase of the power supply signal Sac. Further, the heater controller 57 may vary the triac control signal CTRL1A from the low level to the high level at timing in a range in which the phase of the power supply signal Sac is from 90° to 180°, and at timing in a range in which the phase of the power supply signal Sac is from 270° to 360°, as illustrated in Part (G) of FIG. 5. The timing in the range in which the phase of the power supply signal Sac is from 90° to 180° may be, for example but not limited to, timing t5 and timing t9 in FIG. 5. The timing in the range in which the phase of the power supply signal Sac is from 270° to 360° may be, for example but not limited to, timing t3 and timing t7 in FIG. 5. This may cause the triac 115 of the triac circuit 110A to be turned on, for example but not limited to, in a period from the timing t3 to timing t4, in a period from the timing t5 to timing t6, in a period from the timing t7 to timing t8, and in a period from the timing t9 to timing t10. As a result, the heater controller 57 may perform energization of the heater 42A in the periods described above, as illustrated in Part (H) of FIG. 5.

The heater controller 57 may thus perform the energization of the heater 42A by performing a so-called phase control. This makes it possible to suppress an inrush current. For example, in a case where the heater 42A is a halogen heater, starting of the energization of the heater 42A when the heater 42A is in a cooled state may cause a great inrush current, due to a low resistance value of the heater 42A. Therefore, the heater controller 57 may perform the phase control when the heater 42A is in the cooled state, and thereby decrease an amount of electric power supply to the heater 42A. Further, the heater controller 57 may increase the amount of electric power supply to the heater 42A when the heater 42A is increased in temperature and therefore the current is decreased. The heater controller 57 may be thus able to suppress the inrush current by performing the phase control. In one example, the foregoing phase control may be performed also in a printing operation after the warm-up operation.

In another example case where the heater 42A is a ceramic heater, lowness of the input current may eliminate the necessity of performing the phase control.

The malfunction detection circuit 120A may generate the detection signal DET1A corresponding to turning on and off of the triac 115 of the triac circuit 110A, as illustrated in Part (E) of FIG. 5. For example, when the triac 115 is turned on at the timing t3, the power supply signal Sac may be negative, and a current may therefore flow from the node N1A toward the node NL in the malfunction detection circuit 120A illustrated in FIG. 4. The malfunction detection circuit 120A may thereby cause the detection signal DET1A to be at the low level. An operation similar to the operation described above may be performed also at the timing t7. In contrast, the power supply signal Sac may be positive at the timing t5, the timing t9, etc. Therefore, a current may be prevented from flowing through the malfunction detection circuit 120A illustrated in FIG. 4, and the malfunction detection circuit 120A may therefore keep the detection signal DET1A at the high level. The heater controller 57 may determine, on the basis of the detection signal DET1A described above, that the triac circuit 110A is in a normal operation.

Electric power may be thus fed to the heater 42A, and the warm-up operation may be thereby performed.

Figure 6:
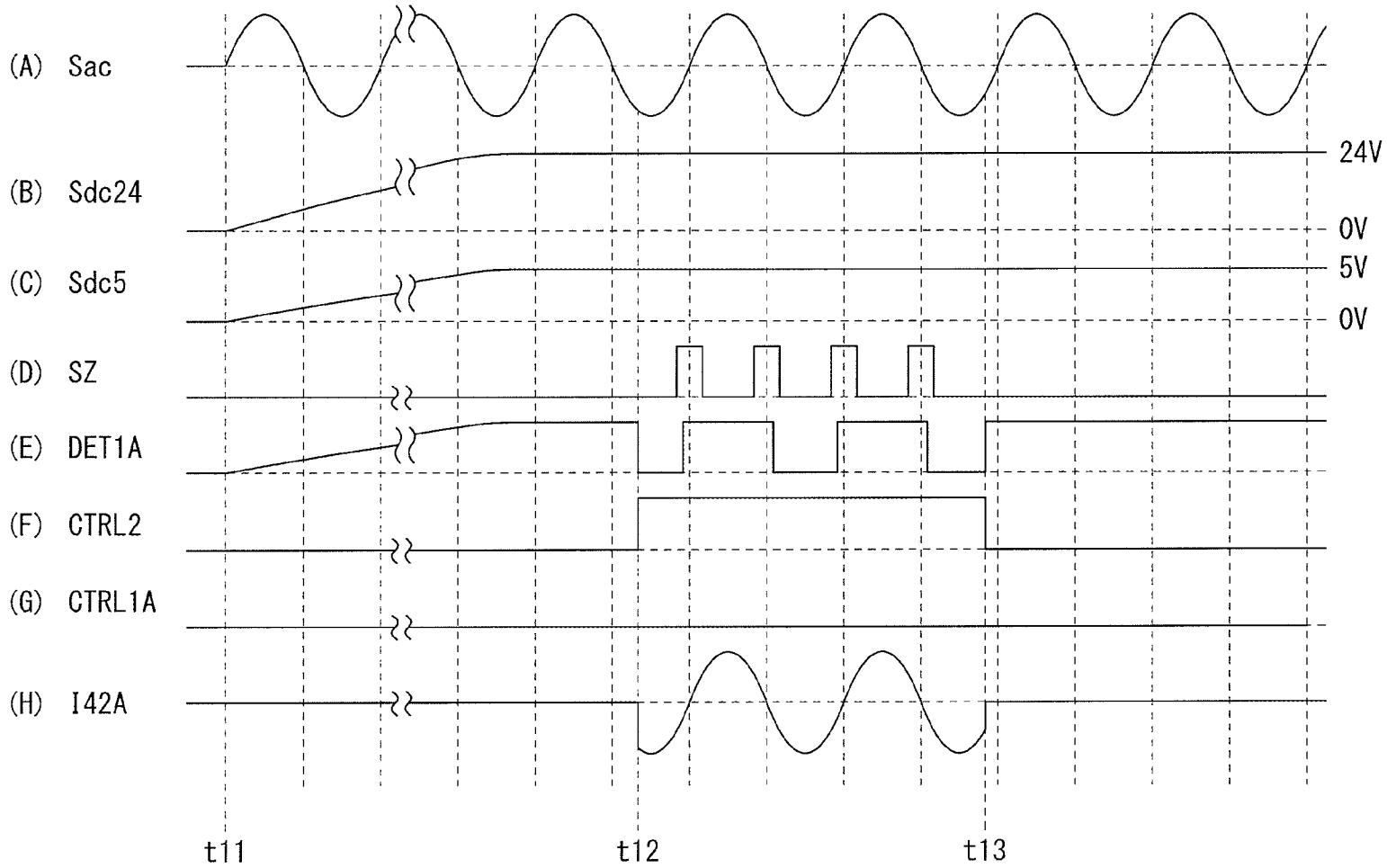
FIG. 6 is a timing waveform diagram illustrating another example of the operation of the power supply unit illustrated in FIG. 4.

FIG. 6 illustrates an example of the operation of the power supply unit 100 in an example case where a malfunction occurs. In this example case, for example, the power supply signal Sac may include a noise or the power supply signal Sac may have a nearly-square waveform, which is not illustrated.

First, at timing t11, the power supply unit 100 may receive the power supply signal Sac from the commercial power supply 99, in response to turning on of a power supply switch of the image forming apparatus 1 by a user, as illustrated in Part (A) of FIG. 6.

Thereafter, at timing t12, the heater controller 57 may vary the relay control signal CTRL2 from the low level to the high level, as illustrated in Part (F) of FIG. 6. This may cause the zero-crossing detection circuit 140 to start generating the zero-crossing signal SZ, as illustrated in Part (D) of FIG. 6.

In a period from the timing t12 to timing t13, the heater controller 57 may keep the triac control signal CTRL1A at the low level, as illustrated in Part (G) of FIG. 6. In other words, it is intended here that the triac 115 of the triac circuit 110A is kept turned off by the heater controller 57. In this example, however, the triac 115 may be turned on due to its malfunction, which may cause energization of the heater 42A, as illustrated in Part (H) of FIG. 6. Such a malfunction of the triac 115 may result from a factor such as the noise in the power supply signal Sac or the distortion in the waveform of the power supply signal Sac. Corresponding to a state where the triac 115 is turned on, the malfunction detection circuit 120A may vary the detection signal DET1A between the low level and the high level in accordance with the power supply signal Sac, as illustrated in Part (E) of FIG. 6. For example, a current may flow from the node N1A toward the node NL in the malfunction detection circuit 120A illustrated in FIG. 4 in a period corresponding to a period during which the power supply signal Sac is negative. As a result, the detection signal DET1A may be at the low level during a period corresponding to the period during which the power supply signal Sac is negative, and may be at the high level during a period other than the period corresponding to the period during which the power supply signal Sac is negative.

The heater controller 57 may determine, on the basis of the detection signal DET1A described above, that the triac 115 of the triac circuit 110A is turned on due to its malfunction. For example, the heater controller 57 may determine that the triac 115 is turned on due to its malfunction, on the basis of a factor such as an edge, a pulse width, or a cycle of the detection signal DET1A. In the example illustrated in FIG. 6, the heater controller 57 may determine the malfunction of the triac 115 on the basis of a state in which the triac 115 is turned on despite the fact that the triac control signal CTRL1A is kept at the low level. Upon the determination of the malfunction of the triac 115, the heater controller 57 may perform determination for a plurality of times in a period corresponding to a plurality of cycles of the power supply signal Sac, in order to prevent erroneous determination. Further, the controller 50 may perform a process directed to fail-safe. For example, the heater controller 57 may vary the relay control signal CTRL2 from the high level to the low level at timing t13, as illustrated in Part (F) of FIG. 6. The energization of the heater 42A may be thus stopped in the image forming apparatus 1. Further, the zero-crossing detection circuit 140 may keep the zero-crossing signal SZ at the low level at and after the timing of stopping of the energization of the heater 42A. Further, the display unit 53 may perform display indicating an error, for example.

As described above, the image forming apparatus 1 may be provided with the malfunction detection circuits 120A and 120B, and thus detect the malfunction of the triac 115 in each of the triac circuits 110A and 110B. For example, the triac 115 may be possibly turned on due to its malfunction in a case where the power supply signal Sac includes a noise, in a case where the power supply signal Sac has the nearly-square waveform, or in any other case that may cause the malfunction of the triac 115. In another example, the triac 115 may be possibly turned on due to its malfunction as a result of so-called thermal runaway. It is possible, however, for the image forming apparatus 1 to detect the malfunction of the triac 115 described above owing to the provision of the malfunction detection circuits 120A and 120B. Accordingly, it is possible to stop the energization of each of the heaters 42A and 42B by turning off the relay circuit 130.

Figure 7:
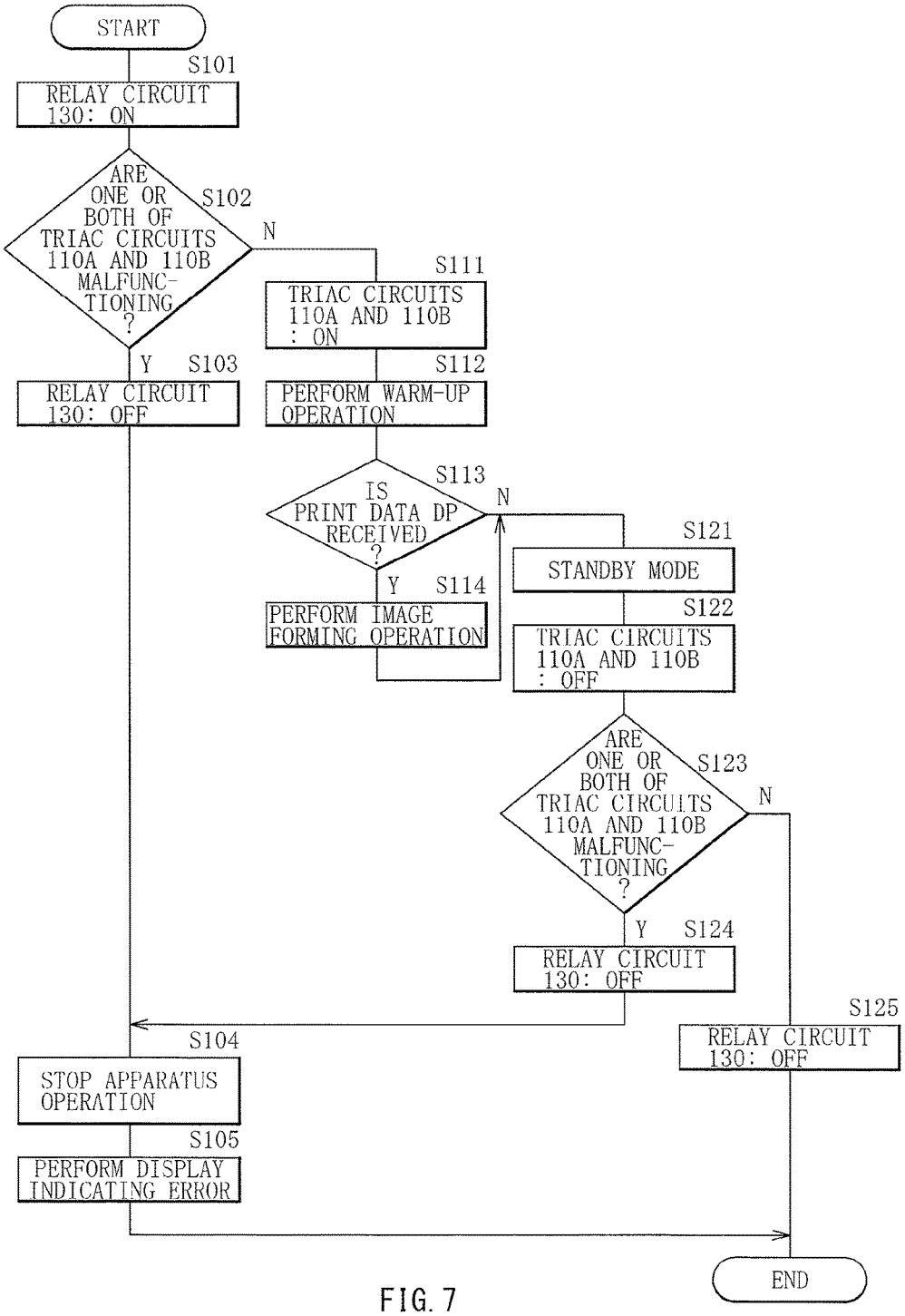
FIG. 7 is a flowchart illustrating an example of an operation of an image forming apparatus according to one example embodiment.

FIG. 7 illustrates an example of an operation of the image forming apparatus 1 after the power is turned on.

In response to the turning on of the power, the heater controller 57 may first turn on the relay 131 of the relay circuit 130 by causing the relay control signal CTRL2 to be at the high level (step S101).

Thereafter, the heater controller 57 may confirm, on the basis of the detection signals DET1A and DET1B, whether one or both of the triac 115 of the triac circuit 110A and the triac 115 of the triac circuit 110B are malfunctioning (step S102).

When one or both of the triac 115 of the triac circuit 110A and the triac 115 of the triac circuit 110B are malfunctioning in step S102 (step S102: Y), the heater controller 57 may turn off the relay 131 of the relay circuit 130 by causing the relay control signal CTRL2 to be at the low level (step S103). Thereafter, the controller 50 may stop an apparatus operation of the image forming apparatus 1 (step S104), and the display unit 53 may perform display indicating occurrence of an error (step S105). This may bring the flow to the end.

When none of the triac 115 of the triac circuit 110A and the triac 115 of the triac circuit 110B is malfunctioning in step S102 (step S102: N), the heater controller 57 may turn on the triac 115 of each of the triac circuits 110A and 110B through the phase control illustrated in FIG. 5 (step S111), and the warm-up operation may be thereby performed (step S112).

Thereafter, the controller 50 may confirm whether the communicator 51 receives the print data DP in a period having a predetermined length (step S113). When the communicator 51 receives the print data DP in the period having the predetermined length (step S113: Y), the image forming apparatus 1 may perform the image forming operation on the basis of the received print data DP (step S114). Thereafter, the flow may proceed to step S121.

When the communicator 51 receives no print data DP in the period having the predetermined length in step S113 (step S113: N), a transition may be made to a standby mode (step S121). Thereafter, the heater controller 57 may turn off both of the triacs 115 of the triac circuits 110A and 110B, by causing both of the triac control signals CTRL1A and CTRL1B to be at the low level (step S122).

Thereafter, the heater controller 57 may confirm, on the basis of the detection signals DET1A and DET1B, whether one or both of the triac 115 of the triac circuit 110A and the triac 115 of the triac circuit 110B are malfunctioning (step S123).

When one or both of the triac 115 of the triac circuit 110A and the triac 115 of the triac circuit 110B are malfunctioning in step S123 (step S123: Y), the heater controller 57 may turn off the relay 131 of the relay circuit 130 by causing the relay control signal CTRL2 to be at the low level (step S124). Thereafter, the flow may proceed to step S104.

When none of the triac 115 of the triac circuit 110A and the triac 115 of the triac circuit 110B is malfunctioning in step S123 (step S123: N), the heater controller 57 may turn off the relay 131 of the relay circuit 130 by causing the relay control signal CTRL2 to be at the low level (step S125).

This may bring the flow to the end. When the communicator 51 receives the print data DP after the foregoing process is brought to the end, the operation may be started again from step S101.

As described above, the detection of the malfunction of the triac 115 may be performed at timing such as timing of the turning on of the power, the timing before the image forming operation is started, and the timing after the image forming operation is finished. Accordingly, even when the triac 115 malfunctions, it is possible to promptly detect the malfunction of the triac 115. As a result, it is possible for the image forming apparatus 1 to turn off the relay 131 of the relay circuit 130 or to perform the display indicating an error, promptly after the occurrence of the malfunction of the triac 115. Hence, it is possible to suppress an influence of the malfunction of the triac 115.

[Example Effects]

According to the first example embodiment, the malfunction detection circuit may be provided, which makes it possible to suppress an influence of the malfunction of the triac, as described above.

[Modification Example 1-1]

Although the detection of the malfunction of the triac 115 of each of the triac circuits 110A and 110B may be performed at timing such as the timing of the turning on of the power, the timing before the image forming operation is started, and the timing after the image forming operation is finished according to the first example embodiment, the timing of the detection of the malfunction of the triac 115 of each of the triac circuits 110A and 110B is not limited thereto. In one example case where printing is continuously performed for a long period of time, the triac 115 of each of the triac circuits 110A and 110B may be turned on and off repeatedly. Therefore, the detection of the malfunction of the triac 115 may be performed utilizing a period during which the triac 115 is turned off.

[Modification Example 1-2]

Figure 8:
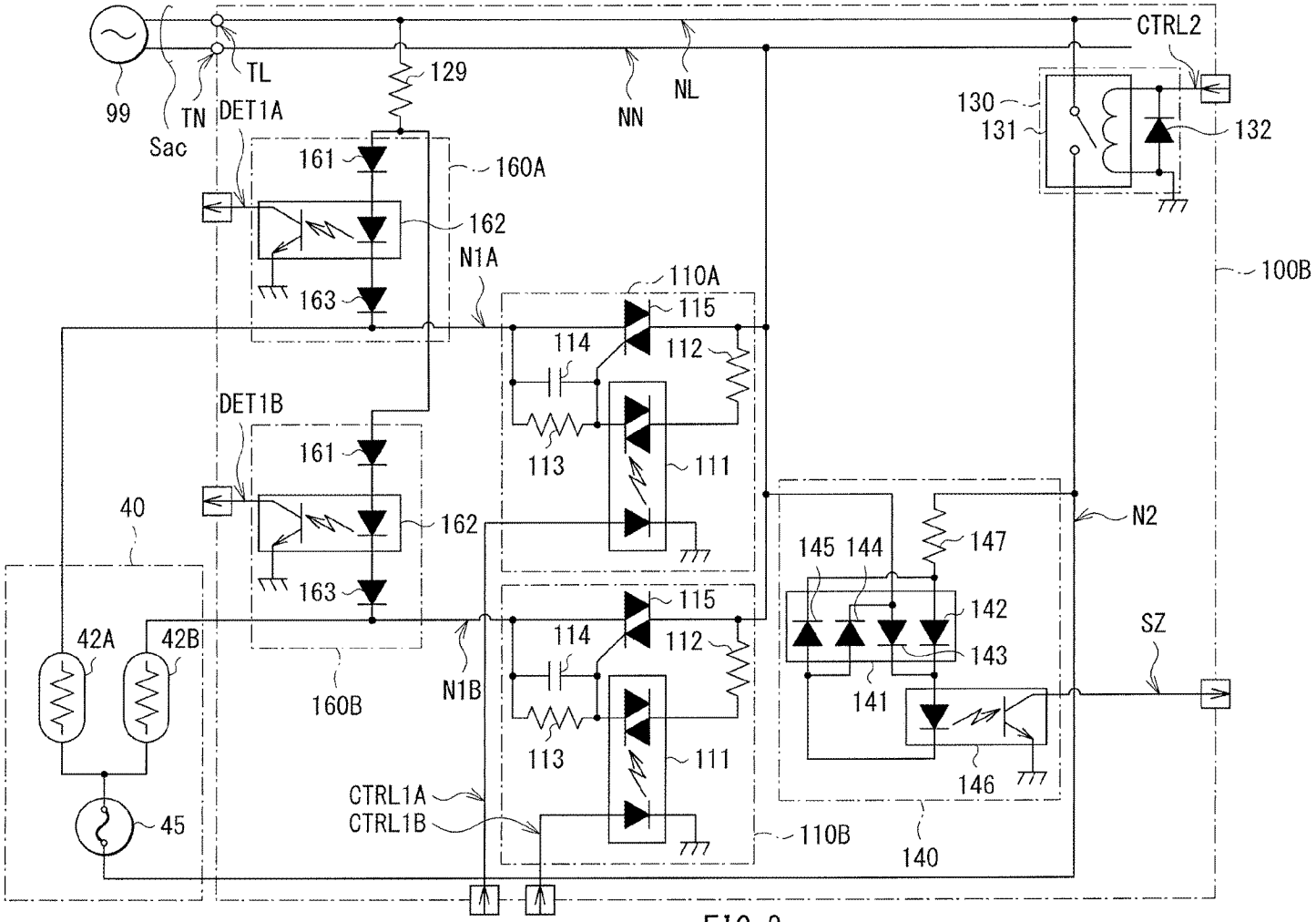
FIG. 8 is a circuit diagram illustrating an example of a configuration of a power supply unit according to a modification example of one example embodiment.

Although the malfunction detection circuits 120A and 120B may have the respective circuit configurations illustrated in FIG. 4 according to the first example embodiment, the circuit configurations of the respective malfunction detection circuits 120A and 120B are not limited thereto. In one example, the directions of the respective diodes may be changed to those of a power supply unit 100B illustrated in FIG. 8. The power supply unit 100B may include a malfunction detection circuit 160A and a malfunction detection circuit 160B. The malfunction detection circuit 160A may include a diode 161, a photocoupler 162, and a diode 163. The diode 161 may have an anode that is coupled to the node NL via the resistor 129, and have a cathode that is coupled to an anode of a light-emitting diode of the photocoupler 162. The photocoupler 162 may include the light-emitting diode having the anode that is coupled to the cathode of the diode 161, and having a cathode that is coupled to an anode of the diode 163. The photocoupler 162 may include a phototransistor having a collector that outputs the detection signal DET1A, and having an emitter that is grounded. The diode 163 may have the anode that is coupled to the cathode of the light-emitting diode of the photocoupler 162, and have a cathode that is coupled to the node N1A.

With this configuration, in the malfunction detection circuit 160A, on a condition that the triac 115 of the triac circuit 110A is turned on, a current may flow from the node NL toward the node N1A via the diode 161, the photocoupler 162, and the diode 163, and the detection signal DET1A may be thereby caused to be at a low level, when a voltage at the node NL is higher than a voltage at the node N1A (the node NN). When the voltage at the node NL is lower than the voltage at the node N1A (the node NN), a current may be prevented from flowing through the malfunction detection circuit 160A, which may cause the detection signal DET1A to be at a high level. In such a manner, the malfunction detection circuit 160A may cause the detection signal DET1A to be at the low level as a result of a state in which the triac 115 of the triac circuit 110A is turned on in a period in which the power supply signal Sac is positive. This may be similarly applicable to the malfunction detection circuit 160B.

Alternatively, in another example, the malfunction detection circuit 120A may have a configuration similar to that of the zero-crossing detection circuit 140, and the detection signal DET1A may be thereby cause to be at the high level near the so-called zero-crossing timing of the power supply signal Sac, on a condition that the triac 115 of the triac circuit 110A is turned on. In this example case, the pulse width of the detection signal DET1A may be smaller than that in the first example embodiment. The pulse width of the detection signal DET1A may be further smaller especially when the power supply signal Sac has a nearly-square waveform. Therefore, it is possible to use the foregoing circuit as the malfunction detection circuit 120A, when the heater controller 57 is able to operate properly on the basis of the detection signal DET1A having the foregoing small pulse width. This may be similarly applicable to the malfunction detection circuit 120B.

[Modification Example 1-3]

Figure 9:
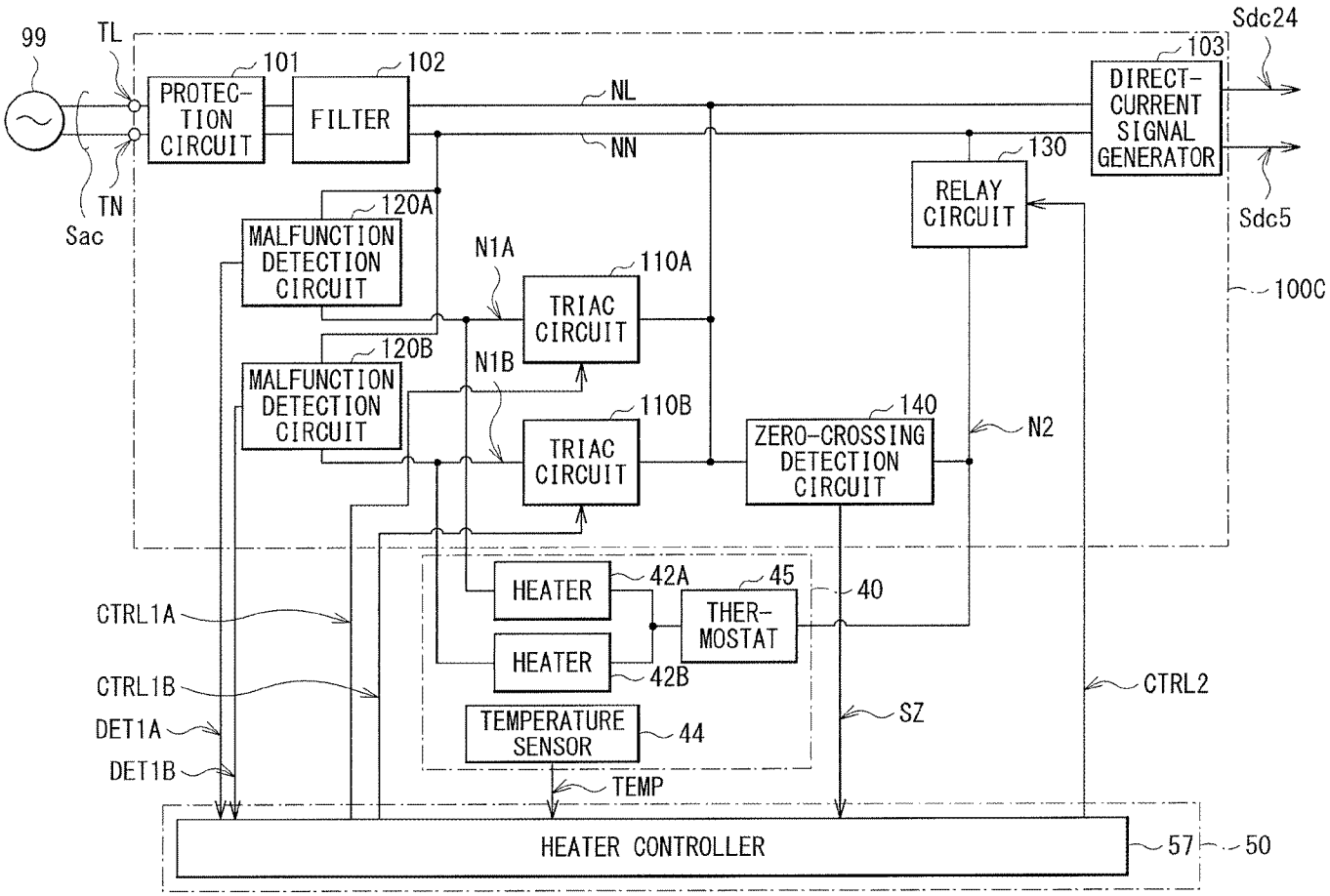
FIG. 9 is a block diagram illustrating an example of a configuration of a power supply unit according to another modification example of one example embodiment.
Figure 10:
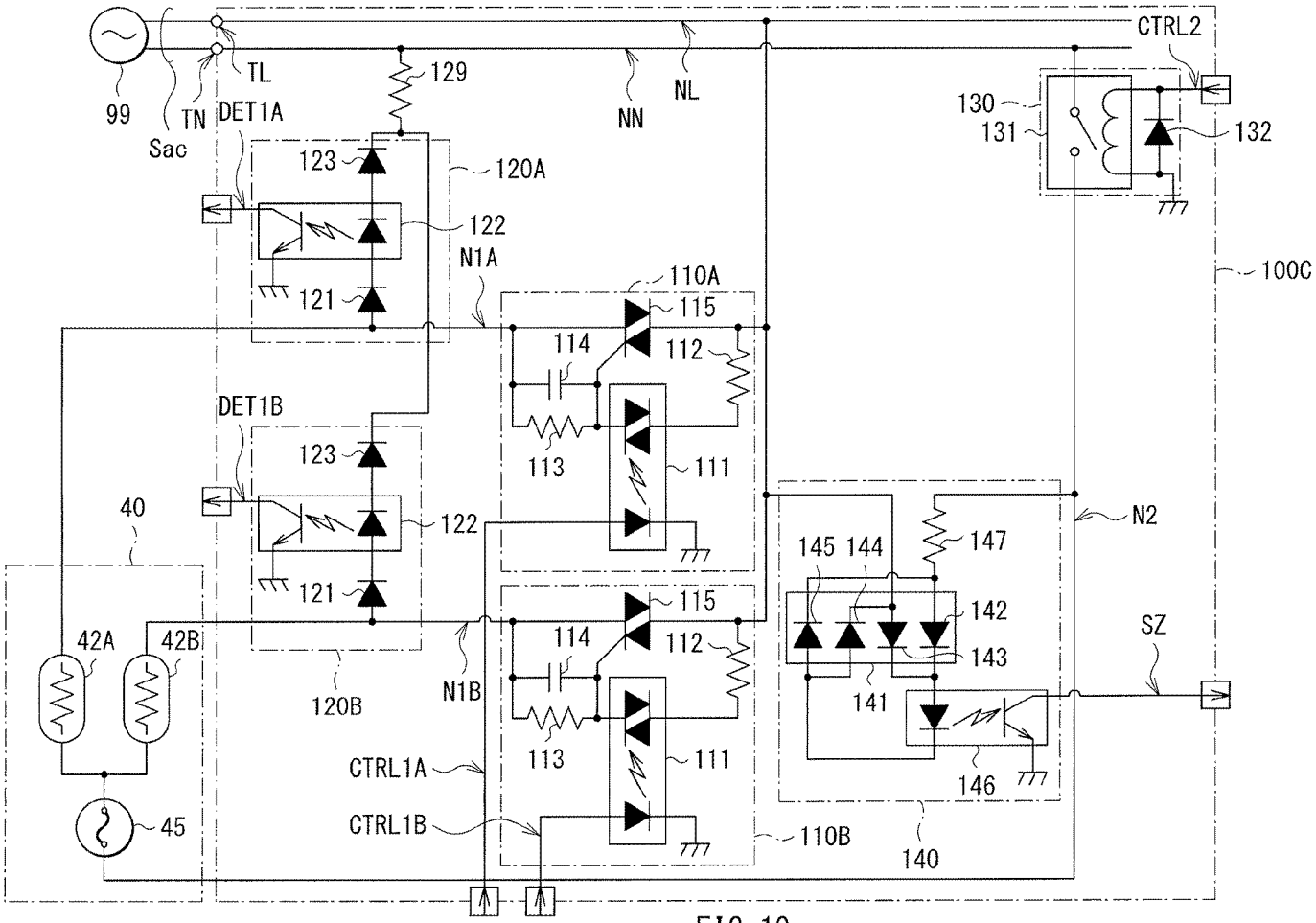
FIG. 10 is a circuit diagram illustrating an example of a configuration of the power supply unit illustrated in FIG. 9.

Although each of the triac circuits 110A and 110B may be coupled to the node NN (neutral), and the relay circuit 130 may be coupled to the node NL (line) as illustrated in FIGS. 3 and 4 in the first example embodiment, the coupling configuration is not limited thereto. Alternatively, in one example, each of the triac circuits 110A and 110B may be coupled to the node NL (line), and the relay circuit 130 may be coupled to the node NN (neutral), as in a power supply unit 100C illustrated in FIGS. 9 and 10. In the power supply unit 100C, the malfunction detection circuit 120A may be coupled to the node NN (neutral).

[Modification Example 1-4]

Although the two malfunction detection circuits 120A and 120B may be provided as illustrated in FIGS. 3 and 4, and the malfunction of the triac 115 of the triac circuit 110A and the malfunction of the triac 115 of the triac circuit 110B may be detected individually in the first example embodiment, the detection of the malfunction is not limited thereto. Alternatively, in one example, a single malfunction detection circuit 150 may be provided, and the malfunction of the triac 115 of the triac circuit 110A and the malfunction of the triac 115 of the triac circuit 110B may be detected together by the single malfunction detection circuit 150, as in a power supply unit 100D illustrated in FIGS. 11 and 12.

The malfunction detection circuit 150 may include a diode 151, a diode 152, a photocoupler 153, a diode 154, and a diode 155. The diode 151 may have an anode that is coupled to the node N1A, and have a cathode that is coupled to both a cathode of the diode 152 and an anode of a light-emitting diode of the photocoupler 153. The diode 152 may have an anode that is coupled to the node N1B, and have the cathode that is coupled to both the cathode of the diode 151 and the anode of the light-emitting diode of the photocoupler 153. The photocoupler 153 may include the light-emitting diode having the anode that is coupled to both the cathode of the diode 151 and the cathode of the diode 152, and having a cathode that is coupled to both an anode of the diode 154 and an anode of the diode 155. The photocoupler 153 may include a phototransistor having a collector that outputs a detection signal DET1, and having an emitter that is grounded. An input terminal, of a heater controller 57D of a controller 50D according to Modification example 1-4, to which the detection signal DET1 is supplied may be provided with a pull-up resistor. The diode 154 may have the anode that is coupled to both the anode of the diode 155 and the cathode of the light-emitting diode of the photocoupler 153, and have a cathode that is coupled to the node NL via the resistor 129. The diode 155 may have the anode that is coupled to both the anode of the diode 154 and the cathode of the light-emitting diode of the photocoupler 153, and have a cathode that is coupled to the node NL via the resistor 129.

The heater controller 57D of the controller 50D according to Modification 1-4 may control the operations of the respective heaters 42A and 42B by generating the triac control signal CTRL1A, the triac control signal CTRL1B, and the relay control signal CTRL2 on the basis of the zero-crossing signal SZ, the detection signal DET1, and the temperature detection signal TEMP.

With this configuration, the malfunction detection circuit 150 causes the detection signal DET1 to be at a low level in a period corresponding to a half cycle of the alternate-current power supply signal Sac, on a condition that one or both of the triac 115 of the triac circuit 110A and the triac 115 of the triac circuit 110B are turned on.

[Other Modification Examples]

Moreover, combination of two or more of the modification examples described above may be applied.

[2. Second Example Embodiment]

A description is given next of an image forming apparatus 2 according to a second example embodiment. According to the second example embodiment, a short-circuit detection circuit that detects a short circuit of the relay 131 of the relay circuit 130 may be further provided. It is to be noted that components substantially the same as those in the image forming apparatus 1 according to the first example embodiment described above may be denoted with the same numerals, and will not be described further where appropriate.

Figure 13:
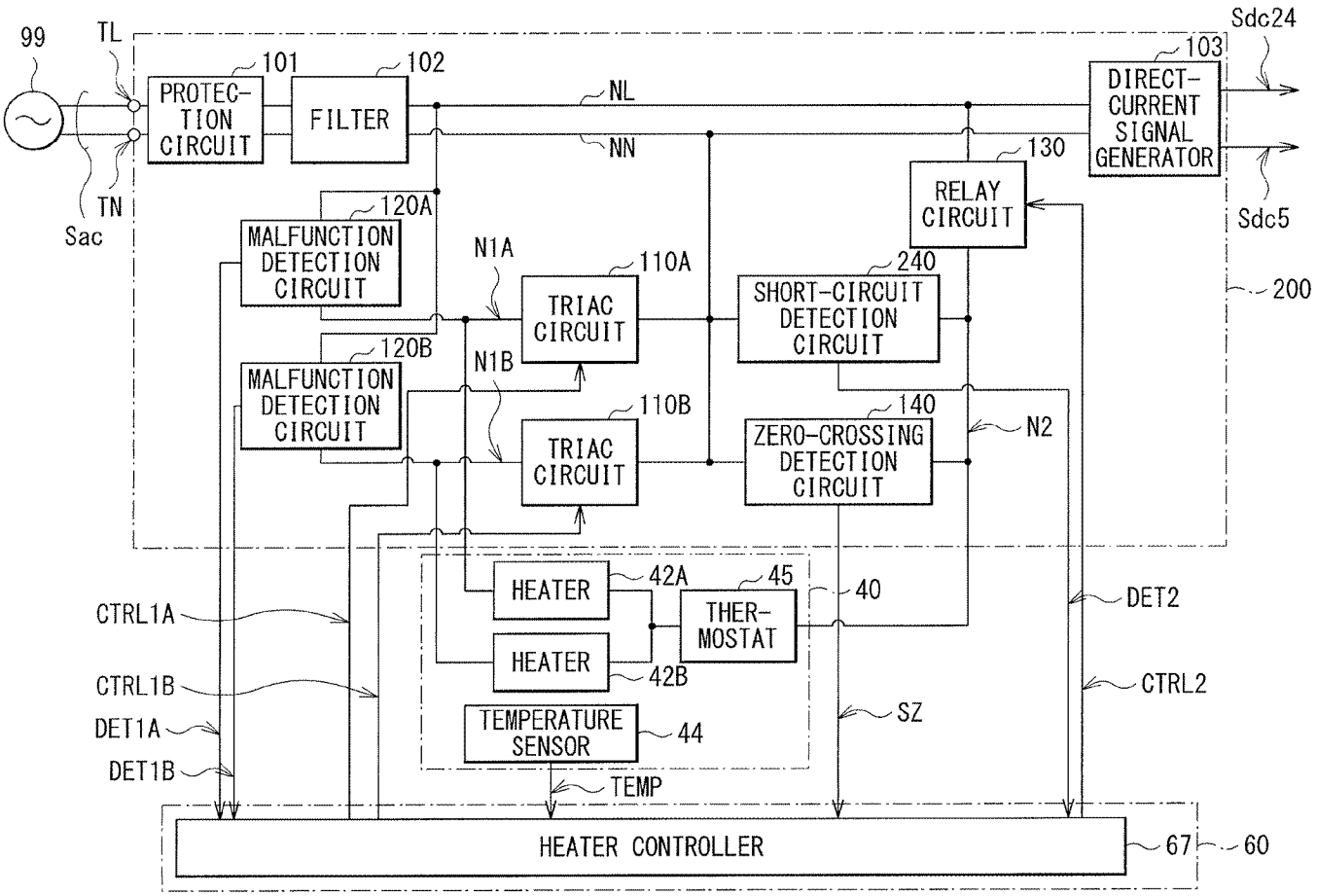
FIG. 13 is a block diagram illustrating an example of a configuration of a power supply unit according to one example embodiment of the technology.

FIG. 13 illustrates an example of a configuration of the image forming apparatus 2. The image forming apparatus 2 may include a controller 60 and a power supply unit 200.

The controller 60 may include a heater controller 67. The heater controller 67 may generate the triac control signal CTRL1A, the triac control signal CTRL1B, and the relay control signal CTRL2 on the basis of the zero-crossing signal SZ, the detection signal DET1A, the detection signal DET1B, a detection signal DET2, and the temperature detection signal TEMP, and thereby control the operations of the respective heaters 42A and 42B.

The power supply unit 200 may include a short-circuit detection circuit 240. The short-circuit detection circuit 240 may output a signal corresponding to turning on and off of the relay 131 of the relay circuit 130, i.e., the detection signal DET2. The short-circuit detection circuit 240 may be inserted between the node NN and the node N2.

Figure 14:
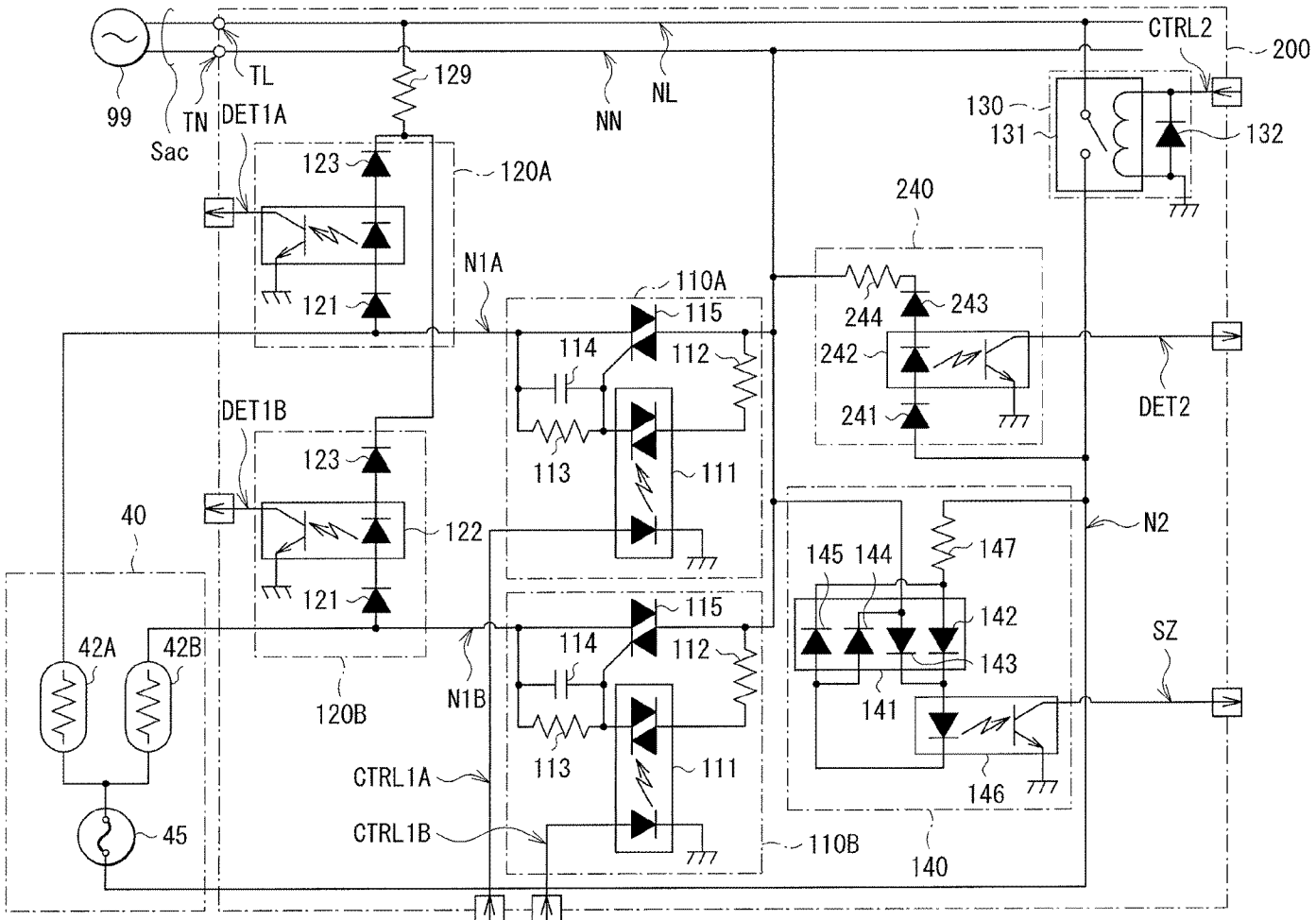
FIG. 14 is a circuit diagram illustrating an example of a configuration of the power supply unit illustrated in FIG. 13.

FIG. 14 illustrates an example of a configuration of a main part of the power supply unit 200. FIG. 14 illustrates the triac circuits 110A and 110B, the malfunction detection circuits 120A and 120B, the relay circuit 130, the short-circuit detection circuit 240, and the zero-crossing detection circuit 140.

The short-circuit detection circuit 240 may include a diode 241, a photocoupler 242, a diode 243, and a resistor 244. The diode 241 may have an anode that is coupled to the node N1, and have a cathode that is coupled to an anode of a light-emitting diode of the photocoupler 242. The photocoupler 242 may include the light-emitting diode having the anode that is coupled to the cathode of the diode 241, and having a cathode that is coupled to an anode of the diode 243. The photocoupler 242 may include a phototransistor having a collector that outputs the detection signal DET2, and having an emitter that is grounded. An input terminal, of the heater controller 67, to which the detection signal DET2 is supplied may be provided with a pull-up resistor. The diode 243 may have the anode that is coupled to the cathode of the light-emitting diode of the photocoupler 242, and have a cathode that is coupled to the resistor 244. The resistor 244 may have a first terminal that is coupled to the cathode of the diode 243, and have a second terminal that is coupled to the node NN.

With this configuration, in the short-circuit detection circuit 240, on a condition that the relay 131 of the relay circuit 130 is turned on, a current may flow from the node N2 toward the node NN via the diode 241, the photocoupler 242, the diode 243, and the resistor 244, and the detection signal DET2 may be thereby caused to be at a low level, when a voltage at the node N2 (the node NL) is higher than a voltage at the node NN. When the voltage at the node N2 (the node NL) is lower than the voltage at the node NN, a current may be prevented from flowing through the short-circuit detection circuit 240, which may cause the detection signal DET2 to be at a high level. In such a manner, the short-circuit detection circuit 240 may cause the detection signal DET2 to be at the low level in a period corresponding to a half cycle of the alternate-current power supply signal Sac, on a condition that the relay 131 of the relay circuit 130 is turned on.

The short-circuit detection circuit 240 may correspond to a "second detector" in one specific but non-limiting embodiment of the technology. The detection signal DET2 may correspond to a "second detection signal" in one specific but non-limiting embodiment of the technology.

Figure 15:
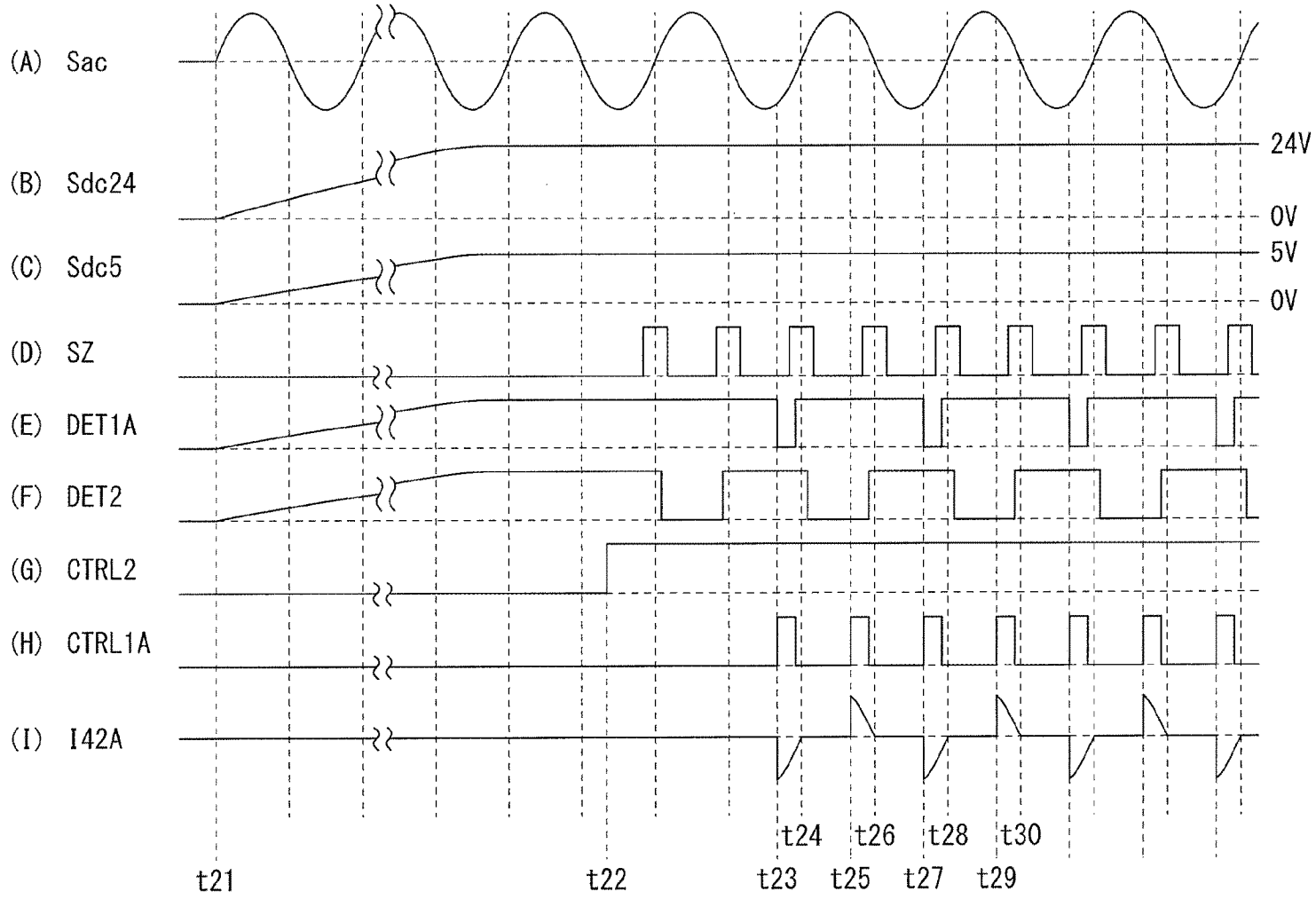
FIG. 15 is a timing waveform diagram illustrating an example of an operation of the power supply unit illustrated in FIG. 14.

FIG. 15 illustrates an example of an operation of the power supply unit 200 upon a normal operation. Part (A) illustrates a waveform of the power supply signal Sac, Part (B) illustrates a waveform of the direct-current signal Sdc24, Part (C) illustrates a waveform of the direct-current signal Sdc5, Part (D) illustrates a waveform of the zero-crossing signal SZ, Part (E) illustrates a waveform of the detection signal DET1A, Part (F) illustrates a waveform of the detection signal DET2, Part (G) illustrates a waveform of the relay control signal CTRL2, Part (H) illustrates the waveform of the triad control signal CTRL1A, and Part (I) illustrates a waveform of a current that flows through the heater 42A, i.e., the heater current 142A.

First, at timing t21, the power supply unit 200 may receive the power supply signal Sac from the commercial power supply 99, as a result of the turning on of the power, as illustrated in Part (A) of FIG. 15.

Thereafter, at timing t22, the heater controller 67 may vary the relay control signal CTRL2 from the low level to the high level, as illustrated in Part (G) of FIG. 15. This may turn on the relay 131 of the relay circuit 130, and therefore, the power supply signal Sac may be supplied to both the zero-crossing detection circuit 140 and the short-circuit detection circuit 240. Further, the zero-crossing detection circuit 140 may start generating the zero-crossing signal SZ, as illustrated in Part (D) of FIG. 15.

The short-circuit detection circuit 240 may generate the detection signal DET2 corresponding to the turning on and off of the relay 131 of the relay circuit 130, as illustrated in Part (F) of FIG. 15. For example, a current may flow from the node N2 toward the node NN in the short-circuit detection circuit 240 illustrated in FIG. 14, in a period corresponding to the period during which the power supply signal Sac is positive. As a result, the detection signal DET2 may be at the low level during the period corresponding to the period during which the power supply signal Sac is positive, and may be at the high level during a period other than the period corresponding to the period during which the power supply signal Sac is positive. The heater controller 67 may determine, on the basis of the detection signal DET2 described above, that the relay circuit 130 is in the normal operation.

Further, the heater controller 67 may generate the triac control signal CTRL1A on the basis of the zero-crossing signal SZ, as illustrated in Part (H) of FIG. 15. This may cause the triac 115 of the triac circuit 110A to be turned on, for example but not limited to, in a period from timing t23 to timing t24, in a period from timing t25 to timing t26, in a period from timing t27 to timing t28, and in a period from timing t29 to timing t30. As a result, the heater controller 67 may perform energization of the heater 42A in the periods described above, as illustrated in Part (I) of FIG. 15.

The malfunction detection circuit 120A may generate the detection signal DET1A corresponding to turning on and off of the triac 115 of the triac circuit 110A, as illustrated in Part (E) of FIG. 15. The heater controller 67 may determine, on the basis of the detection signal DET1A described above, that the triac circuit 110A is in a normal operation.

Electric power may be thus fed to the heater 42A, and the warm-up operation may be thereby performed.

Figure 16:
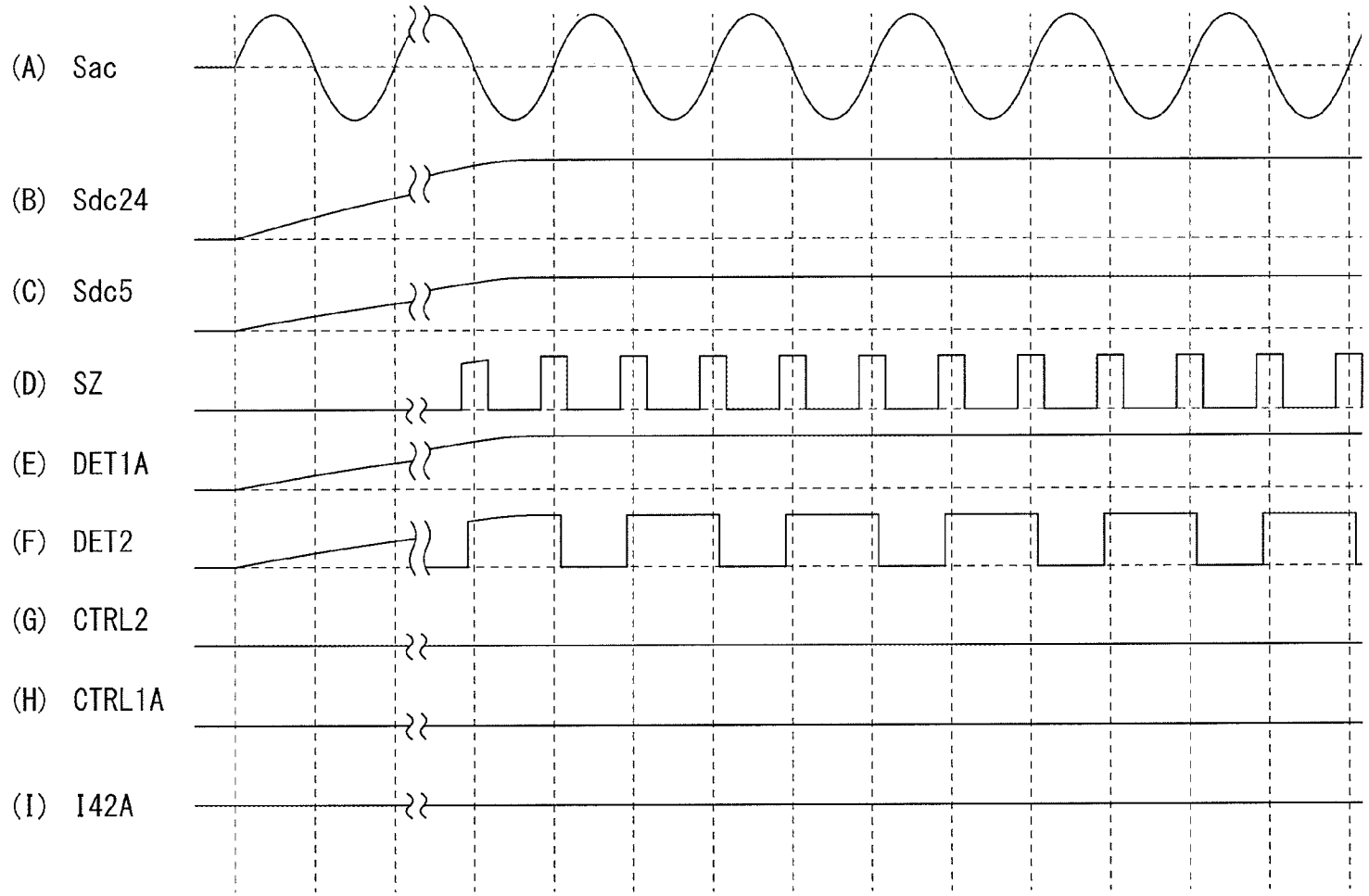
FIG. 16 is a timing waveform diagram illustrating another example of the operation of the power supply unit illustrated in FIG. 14.

FIG. 16 illustrates an example of the operation of the power supply unit 200 in an example case where a malfunction occurs. In this example case, for example, fusing of a contact of the relay 131 may occur as a result of the long-time use, leading to a short circuit at both terminals of the relay 131.

First, at timing t31, the power supply unit 200 may receive the power supply signal Sac from the commercial power supply 99, in response to turning on of a power supply switch of the image forming apparatus 2 by a user, as illustrated in Part (A) of FIG. 16. Thereafter, the zero-crossing detection circuit 140 may start generating the zero-crossing signal SZ, as illustrated in Part (D) of FIG. 16, and the short-circuit detection circuit 240 may start generating the detection signal DET2 that varies in accordance with the power supply signal Sac, as illustrated in Part (F) of FIG. 16. In other words, the heater controller 67 may keep the relay control signal CTRL2 to be at the low level in this example, as illustrated in Part (G) of FIG. 16. It is intended here that the relay 131 of the relay circuit 130 is kept turned off by the heater controller 67. In this example, however, the relay 131 may be short-circuited as a result of the fusing of the contact of the relay 131. This may cause the power supply signal Sac to be supplied to both the zero-crossing detection circuit 140 and the short-circuit detection circuit 240. Accordingly, the zero-crossing detection circuit 140 may generate the zero-crossing signal SZ, and the short-circuit detection circuit 240 may generate the detection signal DET2.

The heater controller 67 may determine, on the basis of the detection signal DET2 described above, that the relay 131 of the relay circuit 130 is short-circuited. For example, the heater controller 67 may determine that the relay 131 is short-circuited, on the basis of a factor such as an edge, a pulse width, or a cycle of the detection signal DET2. In the example illustrated in FIG. 16, the heater controller 67 may determine that the relay 131 is short-circuited, on the basis of a state in which the relay 131 is turned on despite the fact that the relay control signal CTRL2 is kept at the low level. Further, the controller 60 may perform a process directed to fail-safe. For example, the controller 60 may stop the operation of the image forming apparatus 2. Further, the display unit 53 may perform display indicating an error, for example.

As described above, the image forming apparatus 2 may be provided with the short-circuit detection circuit 240, and thus detect the short circuit of the relay 131 of the relay circuit 130. Accordingly, it is possible to stop the energization of each of the heaters 42A and 42B by stopping the operation of the image forming apparatus 2, when the relay 131 is short-circuited.

Figure 17:
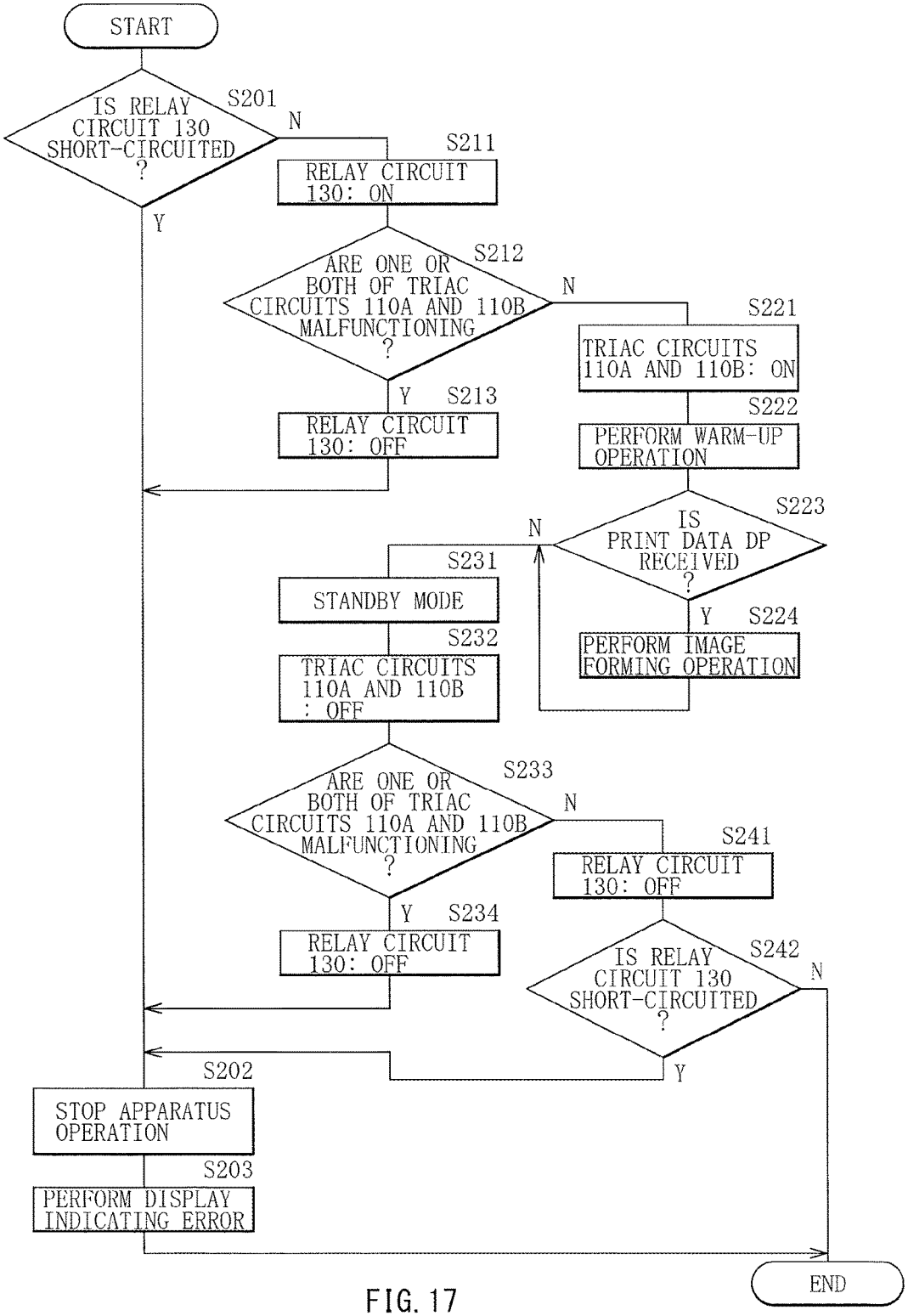
FIG. 17 is a flowchart illustrating an example of an operation of an image forming apparatus according to one example embodiment.

FIG. 17 illustrates an example of an operation of the image forming apparatus 2 after the power is turned on.

In response to the turning on of the power, the heater controller 67 may first confirm, on the basis of the detection signal DET2, whether the relay 131 of the relay circuit 130 is short-circuited (step S201).

When the relay 131 of the relay circuit 130 is short-circuited in step S201 (step S201: Y), the controller 60 may stop the apparatus operation of the image forming apparatus 2 (step S202), and the display unit 53 may perform display indicating occurrence of an error (step S203). This may bring the flow to the end.

When the relay 131 of the relay circuit 130 is not short-circuited in step S201 (step S201: N), the heater controller 67 may turn on the relay 131 of the relay circuit 130 by causing the relay control signal CTRL2 to be at the high level (step S211).

Thereafter, the heater controller 67 may confirm, on the basis of the detection signals DET1A and DET1B, whether one or both of the triac 115 of the triac circuit 110A and the triac 115 of the triac circuit 110B are malfunctioning (step S212).

When one or both of the triac 115 of the triac circuit 110A and the triac 115 of the triac circuit 110B are malfunctioning in step S212 (step S212: Y), the heater controller 67 may turn off the relay 131 of the relay circuit 130 by causing the relay control signal CTRL2 to be at the low level (step S213). Thereafter, the flow may proceed to step S202.

When none of the triac 115 of the triac circuit 110A and the triac 115 of the triac circuit 110B is malfunctioning in step S212 (step S212: N), the heater controller 67 may turn on the triac 115 of each of the triac circuits 110A and 110B through the phase control (step S221), and the warm-up operation may be thereby performed (step S222).

Thereafter, the controller 60 may confirm whether the communicator 51 receives the print data DP in a period having a predetermined length (step S223). When the communicator 51 receives the print data DP in the period having the predetermined length (step S223: Y), the image forming apparatus 2 may perform the image forming operation on the basis of the received print data DP (step S224). Thereafter, the flow may proceed to step S231.

When the communicator 51 receives no print data DP in the period having the predetermined length in step S223 (step S223: N), a transition may be made to a standby mode (step S231). Thereafter, the heater controller 67 may turn off both of the triacs 115 of the triac circuits 110A and 110B by causing both of the triac control signals CTRL1A and CTRL1B to be at the low level (step S232).

Thereafter, the heater controller 67 may confirm, on the basis of the detection signals DET1A and DET1B, whether one or both of the triac 115 of the triac circuit 110A and the triac 115 of the triac circuit 110B are malfunctioning (step S233).

When one or both of the triac 115 of the triac circuit 110A and the triac 115 of the triac circuit 110B are malfunctioning in step S233 (step S233: Y), the heater controller 67 may turn off the relay 131 of the relay circuit 130 by causing the relay control signal CTRL2 to be at the low level (step S234). Thereafter, the flow may proceed to step S202.

When none of the triac 115 of the triac circuit 110A and the triac 115 of the triac circuit 110B is malfunctioning in step S233 (step S233: N), the heater controller 67 may turn off the relay 131 of the relay circuit 130 by causing the relay control signal CTRL2 to be at the low level (step S241).

Thereafter, the heater controller 67 may confirm, on the basis of the detection signal DET2, whether the relay 131 of the relay circuit 130 is short-circuited (step S242). When the relay 131 of the relay circuit 130 is short-circuited (step S242: Y), the flow may proceed to step S202.

When the relay 131 of the relay circuit 130 is not short-circuited in step S242 (step S242: N), the flow may be brought to the end. When the communicator 51 receives the print data DP after the foregoing process is brought to the end, the operation may be started again from step S201.

As described above, the detection of the short circuit of the relay 131 may be performed at timing such as timing of the turning on of the power, the timing before the image forming operation is started, and the timing after the image forming operation is finished. Accordingly, even when the short circuit of the relay 131 occurs, it is possible to promptly detect the short circuit of the relay 131. As a result, it is possible for the image forming apparatus 2 to stop the apparatus operation of the image forming apparatus 2 or to perform the display indicating an error, promptly after the occurrence of the short circuit of the relay 131. Hence, it is possible to suppress an influence of the short circuit of the relay 131.

According to the second example embodiment, the short-circuit detection circuit may be provided, which makes it possible to suppress an influence of the short circuit of the relay, as described above. Effects other than the foregoing effect may be similar to those of the first example embodiment described above.

[Modification Example 2-1]

Although the detection of the short circuit of the relay 131 of the relay circuit 130 may be performed at timing such as the timing of the turning on of the power, the timing before the image forming operation is started, and the timing after the image forming operation is finished according to the second example embodiment, the timing of the detection of the short circuit of the relay 131 of the relay circuit 130 is not limited thereto. In one example case where printing is continuously performed for a long period of time, for example, the relay 131 of the relay circuit 130 may be turned off for a short period of time at timing at which the turning off of the relay 131 has less influence on image formation, and the detection of the short circuit of the relay 131 may be performed in the period during which the relay 131 is turned off.

[Modification Example 2-2]

Figure 18:
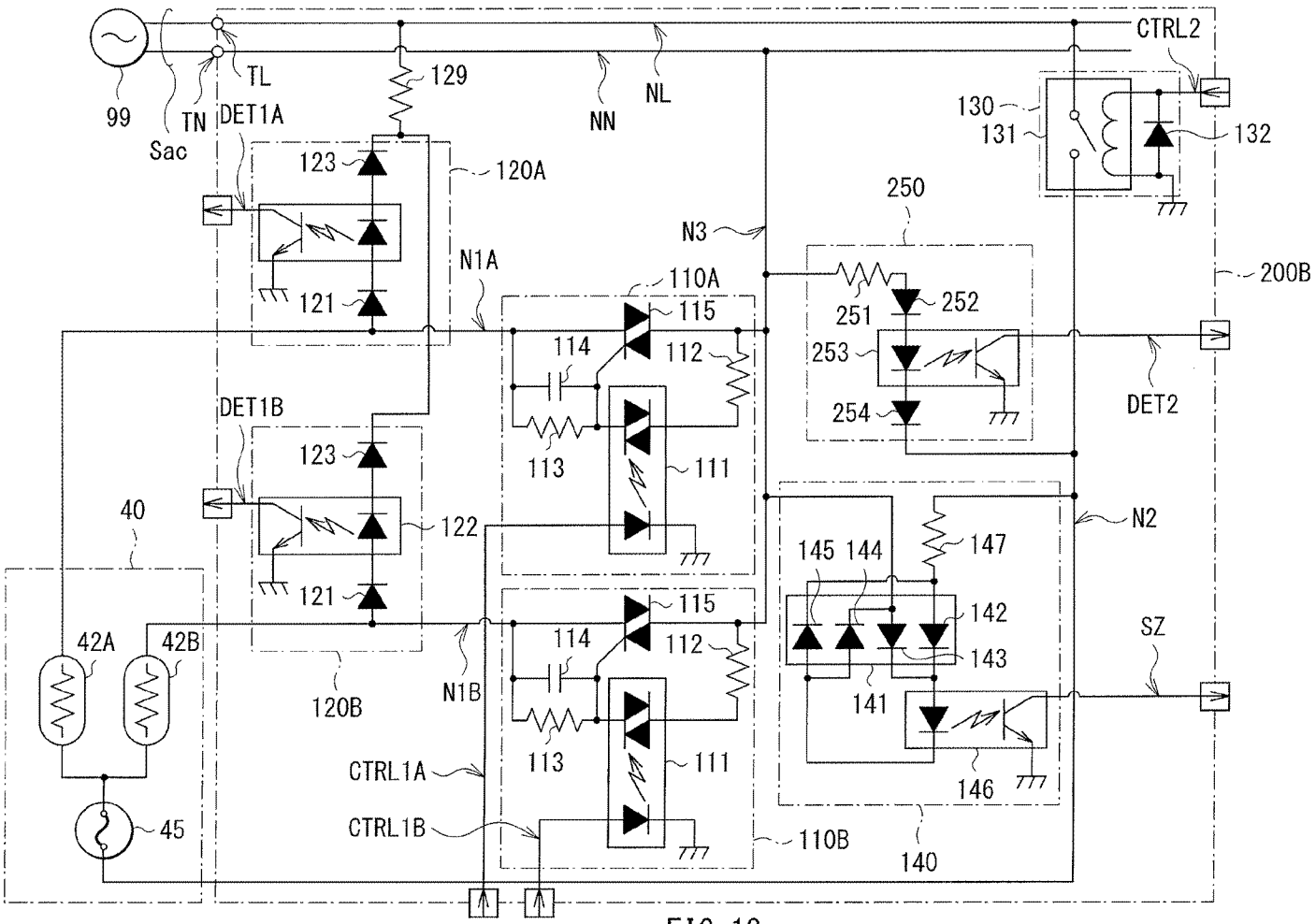
FIG. 18 is a circuit diagram illustrating an example of a configuration of a power supply unit according to a modification example of one example embodiment.

Although the short-circuit detection circuit 240 may have the circuit configuration illustrated in FIG. 14 according to the second example embodiment, the circuit configuration of the short-circuit detection circuit 240 is not limited thereto. In one example, the directions of the respective diodes may be changed to those of a power supply unit 200B illustrated in FIG. 18. The power supply unit 200B may include a short-circuit detection circuit 250. The short-circuit detection circuit 250 may include a resistor 251, a diode 252, a photocoupler 253, and a diode 254. The resistor 251 may have a first terminal that is coupled to the node NN, and have a second terminal that is coupled to an anode of the diode 252. The diode 252 may have the anode that is coupled to the second terminal of the resistor 251, and have a cathode that is coupled to an anode of a light-emitting diode of the photocoupler 253. The photocoupler 253 may include the light-emitting diode having the anode that is coupled to the cathode of the diode 252, and having a cathode that is coupled to an anode of the diode 254. The photocoupler 253 may include a phototransistor having a collector that outputs the detection signal DET2, and having an emitter that is grounded. The diode 254 may have the anode that is coupled to the cathode of the light-emitting diode of the photocoupler 253, and have a cathode that is coupled to the node N2.

With this configuration, in the short-circuit detection circuit 250, on a condition that the relay 131 of the relay circuit 130 is turned on, a current may flow from the node NN toward the node N2 via the resistor 251, the diode 252, the photocoupler 253, and the diode 254, and the detection signal DET2 may be thereby caused to be at a low level, when a voltage at the node NN is higher than a voltage at the node N2 (the node NL). When the voltage at the node NN is lower than the voltage at the node N2 (the node NL), a current may be prevented from flowing through the short-circuit detection circuit 250, which may cause the detection signal DET2 to be at a high level. In such a manner, the short-circuit detection circuit 250 may cause the detection signal DET2 to be at the low level in a period corresponding to a half cycle of the alternate-current power supply signal Sac, on a condition that the relay 131 of the relay circuit 130 is turned on.

Alternatively, in another example, the short-circuit detection circuit 240 may have a configuration similar to that of the zero-crossing detection circuit 140, and the detection signal DET2 may be thereby cause to be at the high level near the so-called zero-crossing timing of the power supply signal Sac, on a condition that the relay 131 of the relay circuit 130 is turned on. In this example case, the pulse width of the detection signal DET2 may be smaller than that in the second example embodiment. The pulse width of the detection signal DET2 may be further smaller especially when the power supply signal Sac has a nearly-square waveform. Therefore, it is possible to use the foregoing circuit as the short-circuit detection circuit 240 when the heater controller 67 is able to operate properly on the basis of the detection signal DET2 having the foregoing small pulse width.

[Other Modification Examples]

Moreover, any of the modification examples of the first example embodiment described above may be also applied to the image forming apparatus 2 according to the second example embodiment described above. Moreover, combination of two or more of the modification examples described above may be applied.

[3. Third Example Embodiment]

A description is given next of an image forming apparatus 3 according to a third example embodiment. According to the third example embodiment, a relay circuit different from the relay circuit 130 may be further provided. It is to be noted that components substantially the same as those in any of the image forming apparatuses 1 and 2 according to the first and second example embodiments described above may be denoted with the same numerals, and will not be described further where appropriate.

Figure 19:
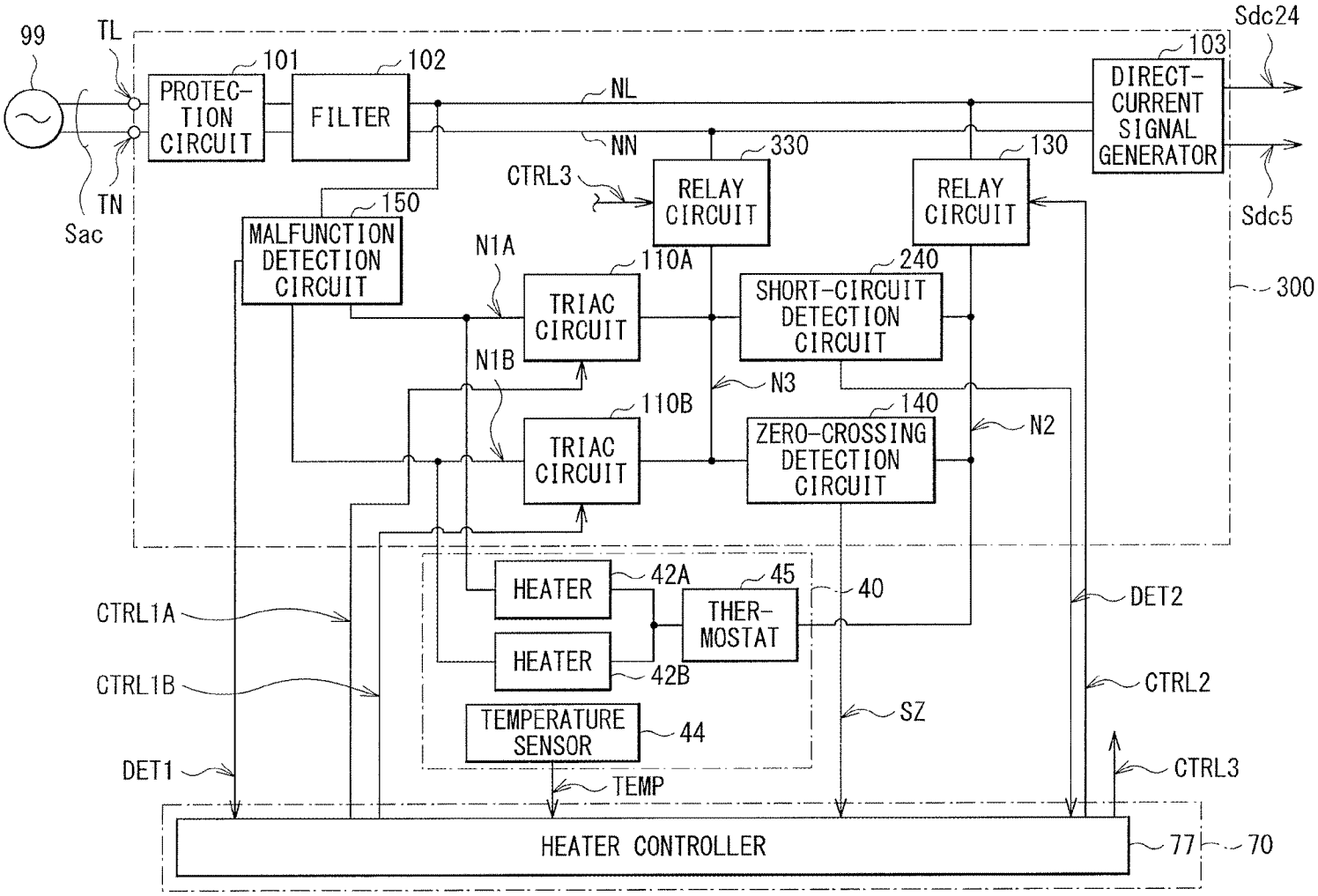
FIG. 19 is a block diagram illustrating an example of a configuration of a power supply unit according to one example embodiment of the technology.

FIG. 19 illustrates an example of a configuration of the image forming apparatus 3. The image forming apparatus 3 may include a controller 70 and a power supply unit 300.

The controller 70 may include a heater controller 77. The heater controller 77 may generate the triac control signal CTRL1A, the triac control signal CTRL the relay control signal CTRL2, and a relay control signal CTRL3, on the basis of the zero-crossing signal SZ, the detection signal DET1, the detection signal DET2, and the temperature detection signal TEMP, and thereby control the operations of the respective heaters 42A and 42B.

The power supply unit 300 may include the malfunction detection circuit 150 and a relay circuit 330. The relay circuit 330 may include a relay. The relay circuit 330 may be turned on and off on the basis of the relay control signal CTRL3. The relay circuit 330 may be inserted between the node NN and the node N3. The node N3 may be coupled to each of the triac circuit 110A, the triac circuit 110B, the zero-crossing detection circuit 140, and the short-circuit detection circuit 240.

Figure 20:
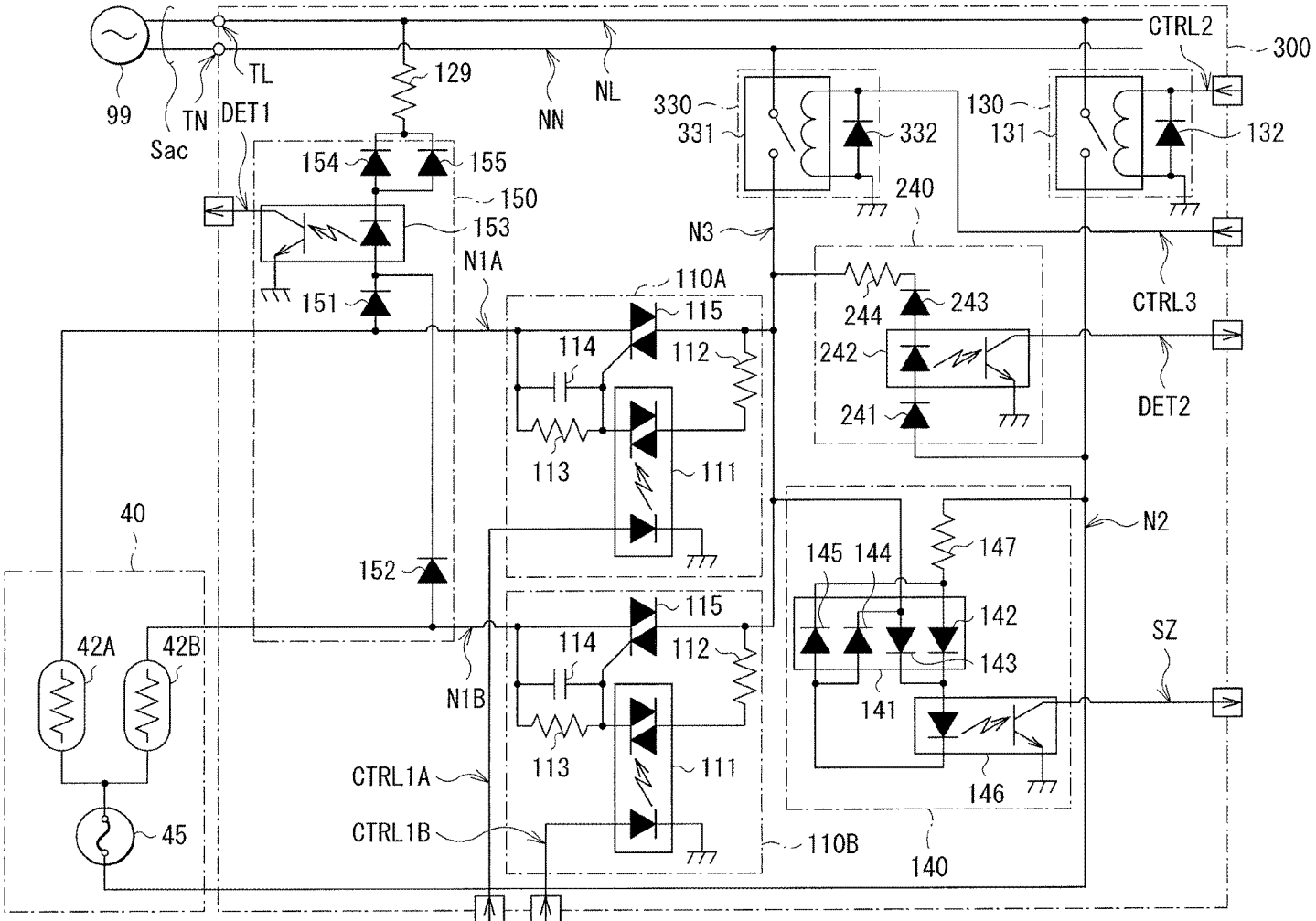
FIG. 20 is a circuit diagram illustrating an example of a configuration o f the power supply unit illustrated in FIG. 19.

FIG. 20 illustrates an example of a configuration of a main part of the power supply unit 300. FIG. 20 illustrates the triac circuits 110A and 110B, the malfunction detection circuit 150, the relay circuits 130 and 330, the short-circuit detection circuit 240, and the zero-crossing detection circuit 140.

The relay circuit 330 may have a configuration similar to that of the relay circuit 130. The relay circuit 330 may include a relay 331 and a diode 332. The relay 331 may include a coil having a first terminal that receives the relay control signal CTRL3 and having a second terminal that is grounded. The relay 331 may include a switch having a first terminal that is coupled to the node NN and a second terminal that is coupled to the node N3. The diode 332 may have an anode that is coupled to the second terminal of the coil of the relay 331, and have a cathode that is coupled to the first terminal of the coil of the relay 331.

This configuration may cause, in the power supply unit 300, the short-circuit detection circuit 240 to output a signal corresponding to turning on and off of one or both of the relay 131 of the relay circuit 130 and the relay 331 of the relay circuit 330, i.e., the detection signal DET2.

The relay circuit 330 may correspond to a "third switch" in one specific but non-limiting embodiment of the technology. The relay control signal CTRL3 may correspond to a "third control signal" in one specific but non-limiting embodiment of the technology. The malfunction detection circuit 150 may correspond to the "first detector" in one specific but non-limiting embodiment of the technology.

Figure 21A:
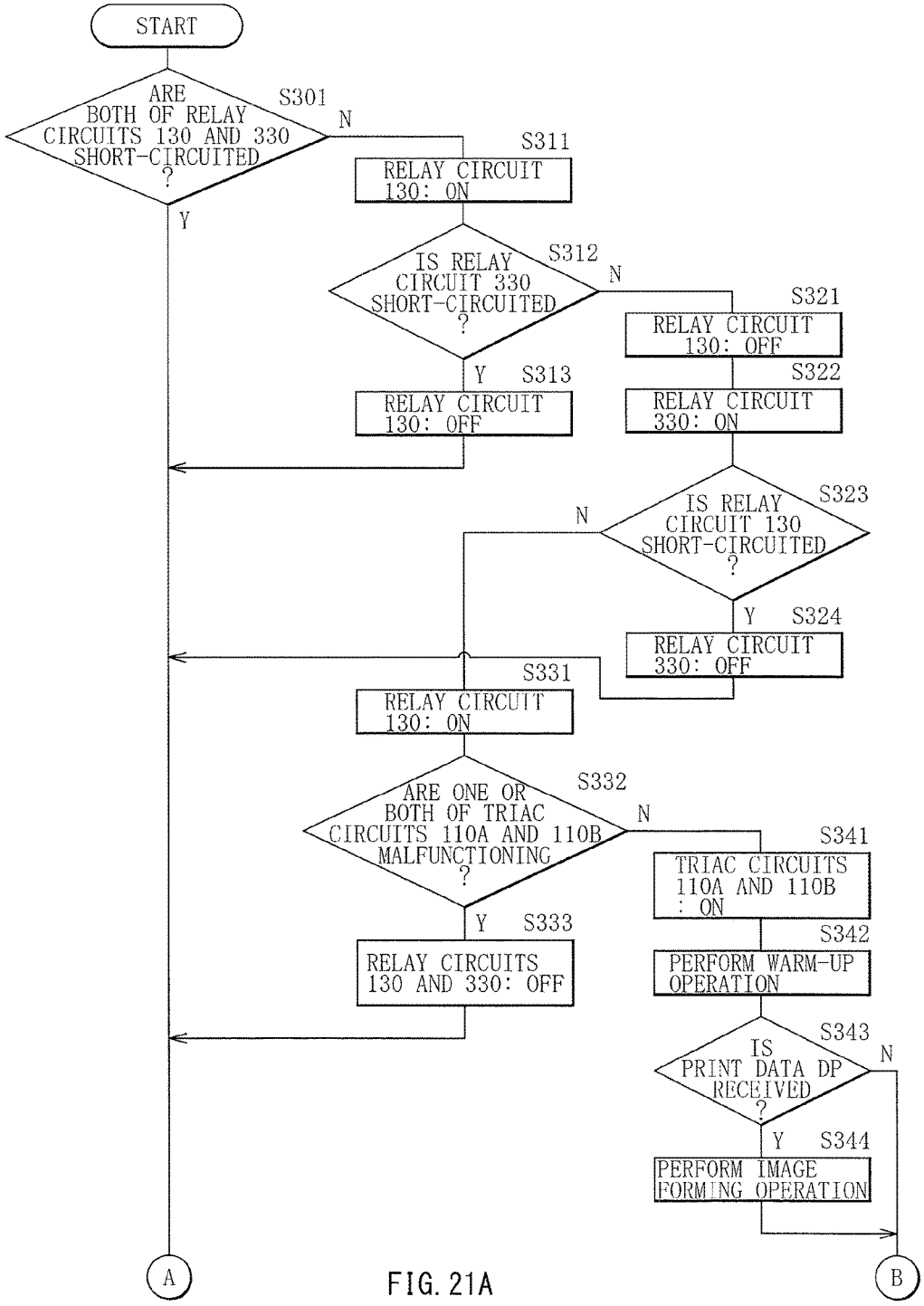
FIG. 21A is a flowchart illustrating an example of an operation of an image forming apparatus according to one example embodiment.
Figure 21B:
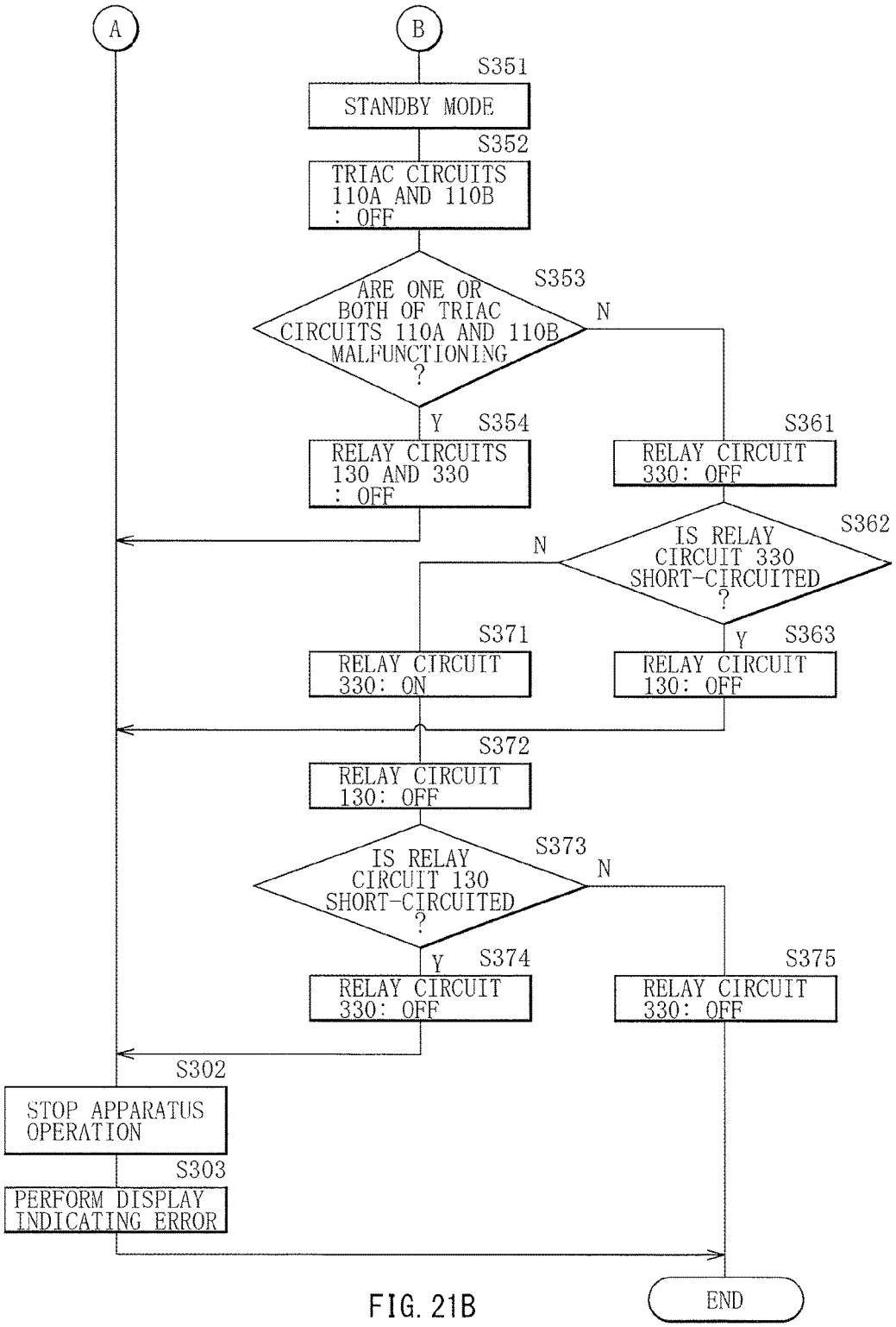
FIG. 21B is another flowchart illustrating the example of the operation of the image forming apparatus according to one example embodiment.

FIGS. 21A and 21B illustrate an example of an operation of the image forming apparatus 3 after the power is turned on.

In response to the turning on of the power, the heater controller 77 may first confirm, on the basis of the detection signal DET2, whether both of the relay 131 of the relay circuit 130 and the relay 331 of the relay circuit 330 are short-circuited (step S301).

When both of the relay 131 of the relay circuit 130 and the relay 331 of the relay circuit 330 are short-circuited in step S301 (step S301: Y), the controller 70 may stop an apparatus operation of the image forming apparatus 3 (step S302), and the display unit 53 may perform display indicating occurrence of an error (step S303). This may bring the flow to the end.

When not both of the relay 131 of the relay circuit 130 and the relay 331 of the relay circuit 330 are short-circuited in step S301 (step S301: N), the heater controller 77 may turn on the relay 131 of the relay circuit 130 by causing the relay control signal CTRL2 to be at the high level (step S311).

Thereafter, the heater controller 77 may confirm, on the basis of the detection signal DET2, whether the relay 331 of the relay circuit 330 is short-circuited (step S312). The relay 131 of the relay circuit 130 is turned on, and the relay 331 of the relay circuit 330 is turned off on this occasion. Therefore, the heater controller 77 may confirm, on the basis of the detection signal DET2, whether the relay 331 of the relay circuit 330 is short-circuited.

When the relay 331 of the relay circuit 330 is short-circuited in step S312 (step S312: Y), the heater controller 77 may turn off the relay 131 of the relay circuit 130 by causing the relay control signal CTRL2 to be at the low level (step S313). Thereafter, the flow may proceed to step S302.

When the relay 331 of the relay circuit 330 is not short-circuited in step S312 (step S312: N), the heater controller 77 may turn off the relay 131 of the relay circuit 130 by causing the relay control signal CTRL2 to be at the low level (step S321), and turn on the relay 331 of the relay circuit 330 by causing the relay control signal CTRL3 to be at the high level (step S322).

Thereafter, the heater controller 77 may confirm, on the basis of the detection signal DET2, whether the relay 131 of the relay circuit 130 is short-circuited (step S323). The relay 131 of the relay circuit 130 is turned off, and the relay 331 of the relay circuit 330 is turned on on this occasion. Therefore, the heater controller 77 may confirm, on the basis of the detection signal DET2, whether the relay 131 of the relay circuit 130 is short-circuited.

When the relay 131 of the relay circuit 130 is short-circuited in step S323 (step S323: Y), the heater controller 77 may turn off the relay 331 of the relay circuit 330 by causing the relay control signal CTRL3 to be at the low level (step S324). Thereafter, the flow may proceed to step S302.

When the relay 131 of the relay circuit 130 is not short-circuited in step S323 (step S323: N), the heater controller 77 may turn on the relay 131 of the relay circuit 130 by causing the relay control signal CTRL2 to be at the high level (step S331). Thus, both the relay 131 of the relay circuit 130 and the relay 331 of the relay circuit 330 may be turned on.

Thereafter, the heater controller 77 may confirm, on the basis of the detection signal DET1, whether one or both of the triac 115 of the triac circuit 110A and the triac 115 of the triac circuit 110B are malfunctioning (step S332).

When one or both of the triac 115 of the triac circuit 110A and the triac 115 of the triac circuit 110B are malfunctioning in step S332 (step S332: Y), the heater controller 77 may turn off both of the relay 131 of the relay circuit 130 and the relay 331 of the relay circuit 330 by causing the respective relay control signals CTRL2 and CTRL3 to be at the low level (step S333). Thereafter, the flow may proceed to step S302.

When none of the triac 115 of the triac circuit 110A and the triac 115 of the triac circuit 110B is malfunctioning in step S332 (step S332: N), the heater controller 77 may turn on the triac 115 of each of the triac circuits 110A and 110B through the phase control (step S341), and the warm-up operation may be thereby performed (step S342).

Thereafter, the controller 70 may confirm whether the communicator 51 receives the print data DP in a period having a predetermined length (step S343). When the communicator 51 receives the print data DP in the period having the predetermined length (step S343: Y), the image forming apparatus 3 may perform the image forming operation on the basis of the received print data DP (step S344). Thereafter, the flow may proceed to step S351.

When the communicator 51 receives no print data DP in the period having the predetermined length in step S343 (step S343: N), a transition may be made to a standby mode (step S351). Thereafter, the heater controller 77 may turn off both of the triacs 115 of the respective triac circuits 110A and 110B, by causing both of the triac control signals CTRL1A and CTRL1B to be at the low level (step S352).

Thereafter, the heater controller 77 may confirm, on the basis of the detection signal DET1, whether one or both of the triac 115 of the triac circuit 110A and the triac 115 of the triac circuit 110B are malfunctioning (step S353).

When one or both of the triac 115 of the triac circuit 110A and the triac 115 of the triac circuit 110B are malfunctioning in step S353 (step S353: Y), the heater controller 77 may turn off both of the relay 131 of the relay circuit 130 and the relay 331 of the relay circuit 330 by causing the respective relay control signals CTRL2 and CTRL3 to be at the low level (step S354). Thereafter, the flow may proceed to step S302.

When none of the triac 115 of the triac circuit 110A and the triac 115 of the triac circuit 110B is malfunctioning in step S353 (step S353: N), the heater controller 77 may turn off the relay 331 of the relay circuit 330 by causing the relay control signal CTRL3 to be at the low level (step S361).

Thereafter, the heater controller 77 may confirm, on the basis of the detection signal DET2, whether the relay 331 of the relay circuit 330 is short-circuited (step S362). The relay 131 of the relay circuit 130 is turned on, and the relay 331 of the relay circuit 330 is turned off on this occasion. Therefore, the heater controller 77 may confirm, on the basis of the detection signal DET2, whether the relay 331 of the relay circuit 330 is short-circuited.

When the relay 331 of the relay circuit 330 is short-circuited in step S362 (step S362: Y), the heater controller 77 may turn off the relay 131 of the relay circuit 130 by causing the relay control signal CTRL2 to be at the low level (step S363). Thereafter, the flow may proceed to step S302.

When the relay 331 of the relay circuit 330 is not short-circuited in step S362 (step S362: N), the heater controller 77 may turn on the relay 331 of the relay circuit 330 by causing the relay control signal CTRL3 to be at the high level (step S371), and turn off the relay 131 of the relay circuit 130 by causing the relay control signal CTRL2 to be at the low level (step S372).

Thereafter, the heater controller 77 may confirm, on the basis of the detection signal DET2, whether the relay 131 of the relay circuit 130 is short-circuited (step S373). The relay 131 of the relay circuit 130 is turned off, and the relay 331 of the relay circuit 330 is turned on on this occasion. Therefore, the heater controller 77 may confirm, on the basis of the detection signal DET2, whether the relay 131 of the relay circuit 130 is short-circuited.

When the relay 131 of the relay circuit 130 is short-circuited in step S373 (step S373: Y), the heater controller 77 may turn off the relay 331 of the relay circuit 330 by causing the relay control signal CTRL3 to be at the low level (step S374). Thereafter, the flow may proceed to step S302.

When the relay 131 of the relay circuit 130 is not short-circuited in step S373 (step S373: N), the heater controller 77 may turn off the relay 331 of the relay circuit 330 by causing the relay control signal CTRL3 to be at the low level (step S375).

This may bring the flow to the end. When the communicator 51 receives the print data DP after the foregoing process is brought to the end, the operation may be started again from step S301.

According to the third example embodiment, a short circuit of the relay is detectable as in the first and second example embodiments, also in a case where two relay circuits are provided, as described above. Effects other than the foregoing effect may be similar to those of the first or second example embodiment described above.

[Other Modification Examples]

Moreover, any of the modification examples of the first and second example embodiments described above may be also applied to the image forming apparatus 3 according to the third example embodiment described above. Moreover, combination of two or more of the modification examples described above may be applied.

4. Fourth Example Embodiment

A description is given next of an image forming apparatus 4 according to a fourth example embodiment. According to the fourth example embodiment, a short-circuit detection circuit that is able to generate the zero-crossing signal SZ may be provided. It is to be noted that components substantially the same as those in any of the image forming apparatuses 1 to 3 according to the first to third example embodiments described above may be denoted with the same numerals, and will not be described further where appropriate.

Figure 22:
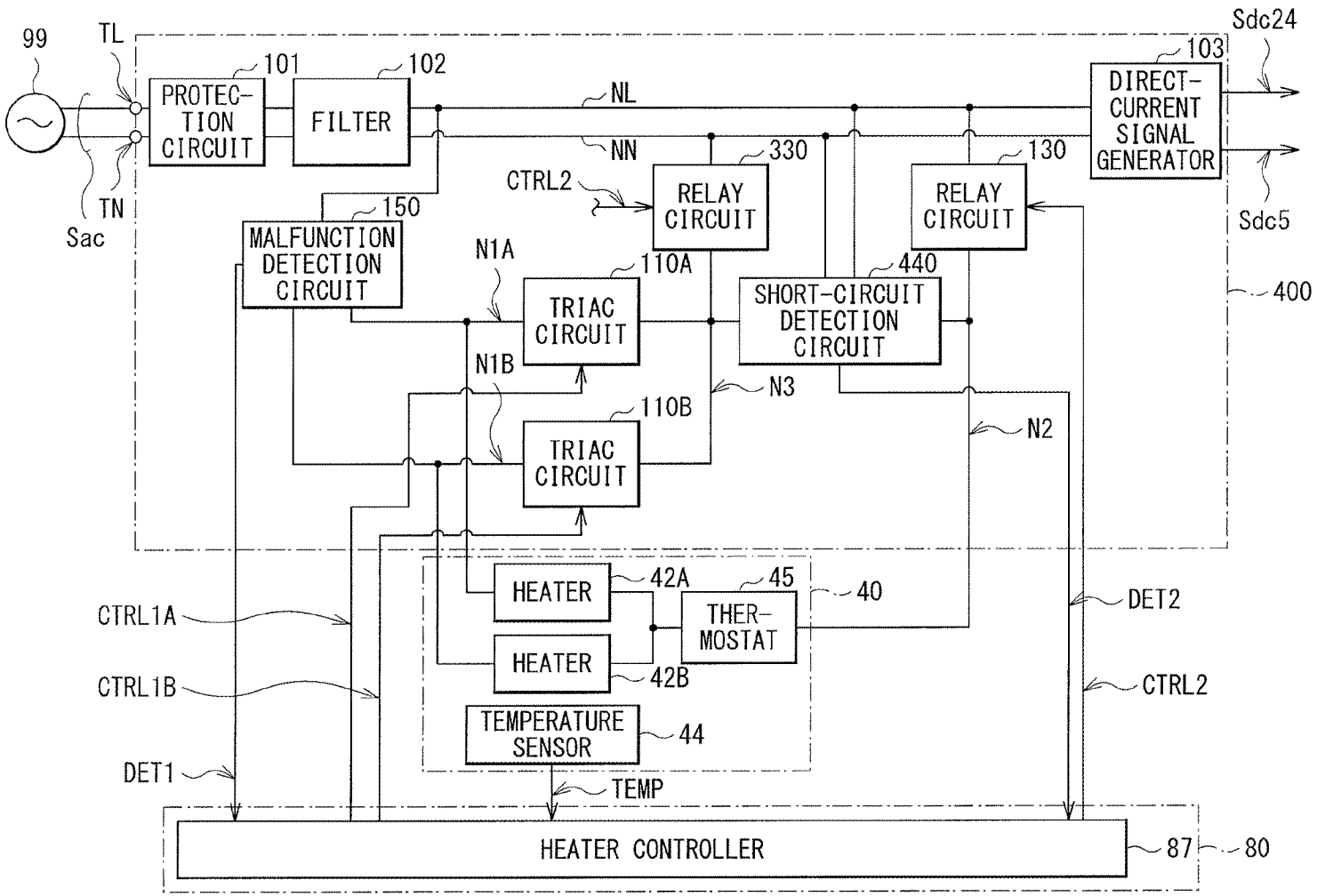
FIG. 22 is a block diagram illustrating an example of a configuration of a power supply unit according to one example embodiment of the technology.

FIG. 22 illustrates an example of a configuration of the image forming apparatus 4. The image forming apparatus 4 may include a controller 80 and a power supply unit 400.

The controller 80 may include a heater controller 87. The heater controller 87 may generate the triac control signal CTRL1A, the triac control signal CTRL1B, and the relay control signal CTRL2, on the basis of the detection signal DET1, the detection signal DET2, and the temperature detection signal TEMP, and thereby control the operations of the respective heaters 42A and 42B.

The power supply unit 400 may include the malfunction detection circuit 150 and a short-circuit detection circuit 440. The short-circuit detection circuit 440 may output a signal corresponding to turning on and off of one or both of the relay 131 of the relay circuit 130 and the relay 331 of the relay circuit 330, i.e., the detection signal DET2. The short-circuit detection circuit 440 may be configured to also generate the zero-crossing signal SZ on the basis of the power supply signal Sac and output the generated zero-crossing signal SZ as the detection signal DET2. The short-circuit detection circuit 440 may be coupled to each of the nodes NL, NN, N2, and N3.

The relay circuits 130 and 330 of the power supply unit 400 may be both turned on and off on the basis of the single relay control signal CTRL2.

Figure 23:
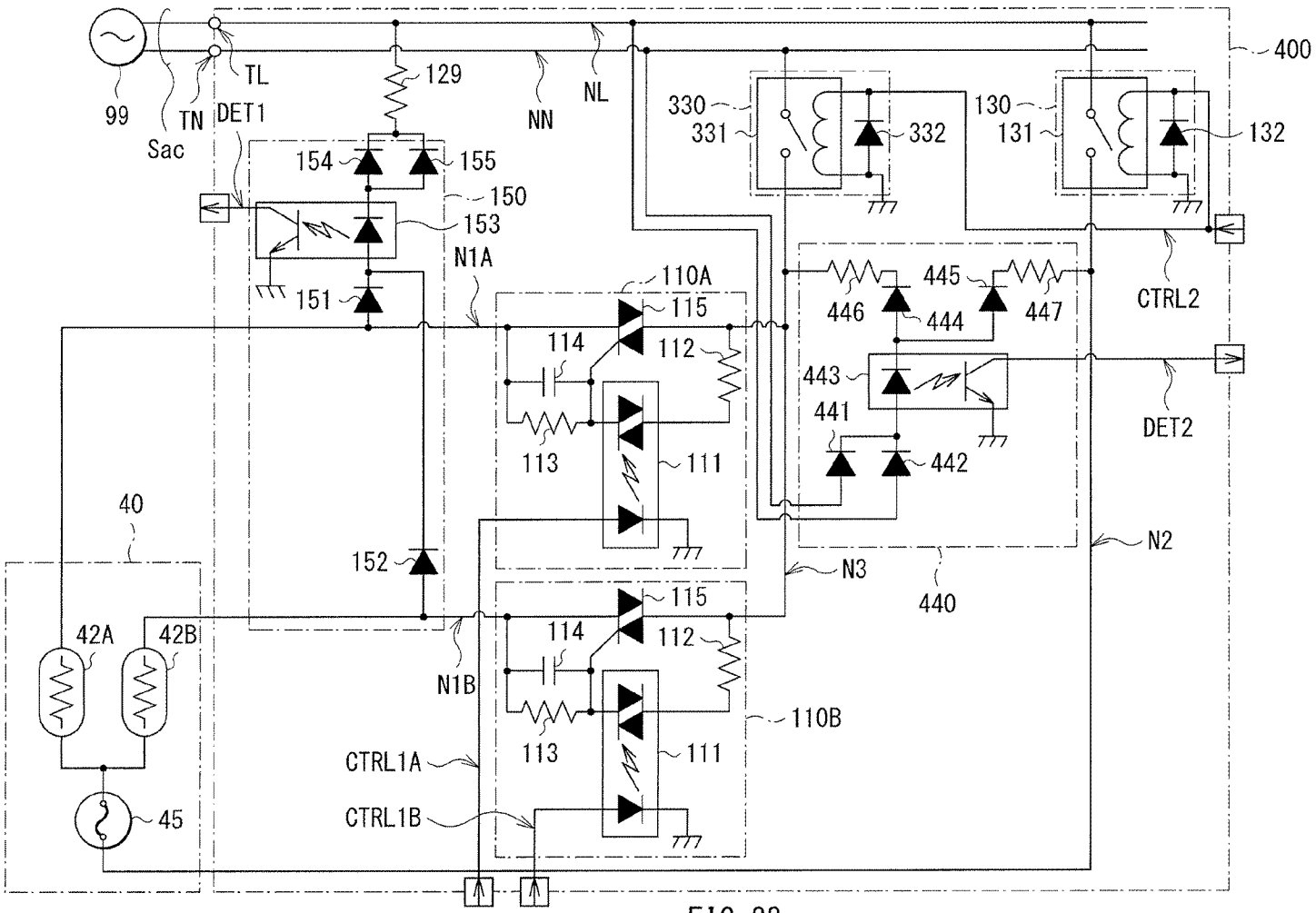
FIG. 23 is a circuit diagram illustrating an example of a configuration of the power supply unit illustrated in FIG. 22.

FIG. 23 illustrates an example of a configuration of a main part of the power supply unit 400. FIG. 23 illustrates the triac circuits 110A and 110B, the malfunction detection circuit 150, the relay circuits 130 and 330, and the short-circuit detection circuit 440.

The short-circuit detection circuit 440 may include a diode 441, a diode 442, a photocoupler 443, a diode 444, a diode 445, a resistor 446, and a resistor 447. The diode 441 may have an anode that is coupled to the node NN, and have a cathode that is coupled to both a cathode of the diode 442 and an anode of a light-emitting diode of the photocoupler 443. The diode 442 may have an anode that is coupled to the node NL, and have a cathode that is coupled to both the cathode of the diode 441 and the anode of the light-emitting diode of the photocoupler 443. The photocoupler 443 may include the light-emitting diode having the anode that is coupled to both the cathode of the diode 441 and the cathode of the diode 442, and having a cathode that is coupled to both an anode of the diode 444 and an anode of the diode 445. The photocoupler 443 may include a phototransistor having a collector that outputs the detection signal DET2, and having an emitter that is grounded. The diode 444 may have the anode that is coupled to both the anode of the diode 445 and the cathode of the light-emitting diode of the photocoupler 443, and have a cathode that is coupled to a first terminal of the resistor 446. The diode 445 may have the anode that is coupled to both the anode of the diode 444 and the cathode of the light-emitting diode of the photocoupler 443, and have a cathode that is coupled to a first terminal of the resistor 447. The resistor 446 may have the first terminal that is coupled to the cathode of the diode 444, and have a second terminal that is coupled to the node N3. The resistor 447 may have the first terminal that is coupled to the cathode of the diode 445, and a second terminal that is coupled to the node N2.

This configuration may cause the short-circuit detection circuit 440 to output the detection signal DET2 corresponding to turning on and off of one or both of the relay 131 of the relay circuit 130 and the relay 331 of the relay circuit 330. For example, in the short-circuit detection circuit 440, a current may flow from the node NN toward the node N2 via the diode 441, the photocoupler 443, the diode 445, and the resistor 447, and thereby cause the detection signal DET2 to be at a low level, on a condition that the relay 131 of the relay circuit 130 is turned on, the relay 331 of the relay circuit 330 is turned off, and a voltage at the node NN is higher than a voltage at the node N2 (the node NL). On a condition that the relay 131 of the relay circuit 130 is turned off, the relay 331 of the relay circuit 330 is turned on, and a voltage at the node NL is higher than a voltage at the node N3 (the node NN), a current may flow from the node NL toward the node N3 via the diode 442, the photocoupler 443 the diode 444, and the resistor 446, and thereby cause the detection signal DET2 to be at a low level. In such a manner, the short-circuit detection circuit 440 may output the detection signal DET2 corresponding to the turning on and off of one or both of the relay 131 of the relay circuit 130 and the relay 331 of the relay circuit 330.

Further, the short-circuit detection circuit 440 may generate the zero-crossing signal SZ on the basis of the power supply signal Sac, and output the generated zero-crossing signal SZ as the detection signal DET2. For example, in the short-circuit detection circuit 440, on a condition, for example, that both of the relay 131 of the relay circuit 130 and the relay 331 of the relay circuit 330 are turned on, a current may flow from the node NN toward the node N2 via the diode 441, the photocoupler 443, the diode 445, and the resistor 447, and the detection signal DET2 may be thereby caused to be at a low level, when the voltage at the node NN is higher than the voltage at the node N2 (the node NL). Alternatively, when the voltage at the node NL is higher than the voltage at the node N3 (the node NN), a current may flow from the node NL toward the node N3 via the diode 442, the photocoupler 443, the diode 444, and the resistor 446, and the detection signal DET2 may be thereby caused to be at a low level. Alternatively, when the voltage at the node NL is substantially the same as the voltage at the node NN, a current may be prevented from flowing through the short-circuit detection circuit 440, and the detection signal DET2 may be thereby caused to be at the high level. In such a manner, the short-circuit detection circuit 440 may cause the detection signal DET2 to be at the high level near the so-called zero-crossing timing of the power supply signal Sac.

It is to be noted that the configuration of the short-circuit detection circuit 440 is not limited to the configuration described above. The short-circuit detection circuit 440 may be any of various circuits that are coupled to each of the nodes NL, NN, N2, and N3.

The short-circuit detection circuit 440 may correspond to a "third detector" in one specific but non-limiting embodiment of the technology. The detection signal DET2 may correspond to a "third detection signal" in one specific but non-limiting embodiment of the technology.

Figure 24:
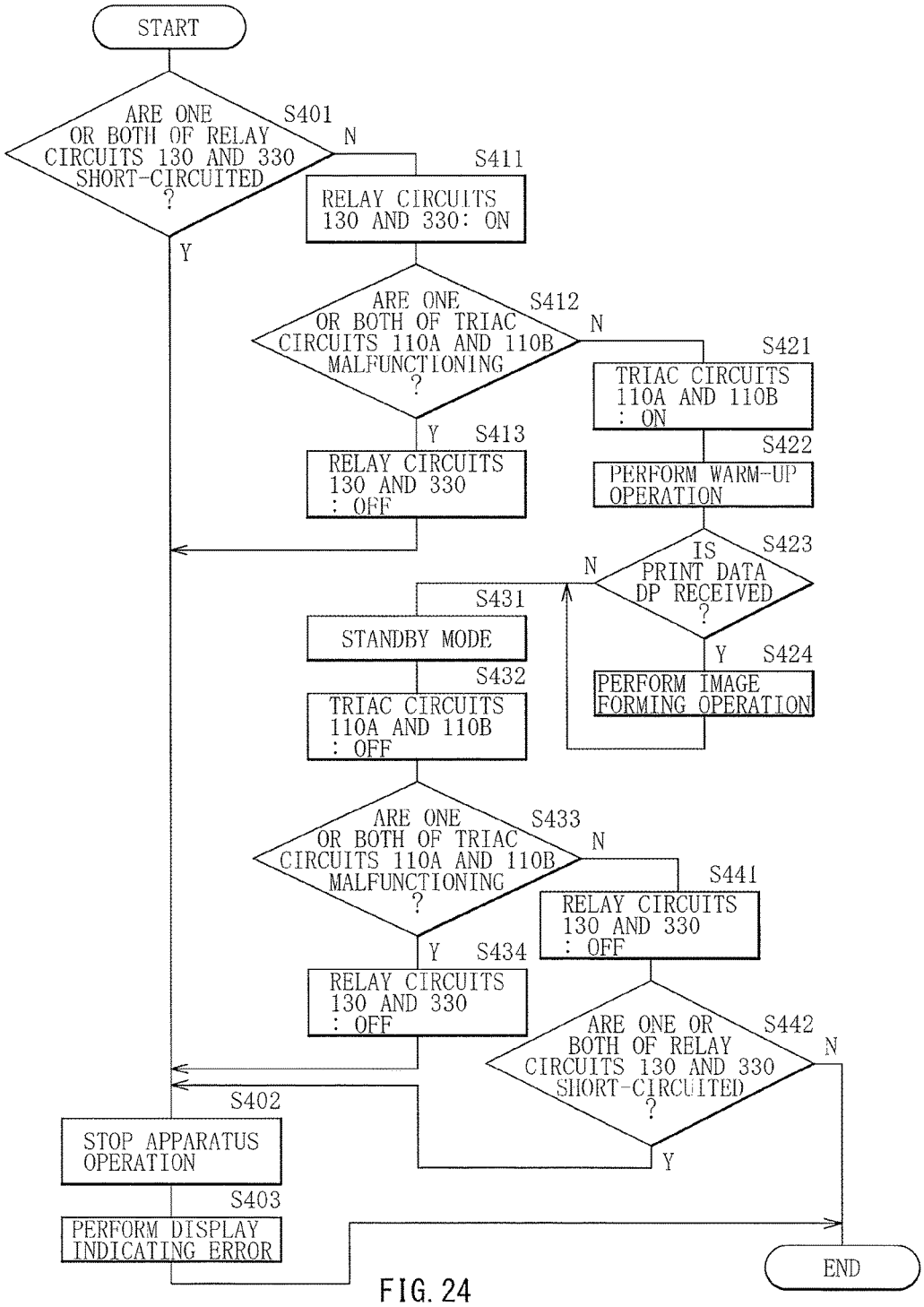
FIG. 24 is a flowchart illustrating an example of an operation of an image forming apparatus according to one example embodiment.

FIG. 24 illustrates an example of an operation of the image forming apparatus 4 after the power is turned on.

In response to the turning on of the power, the heater controller 87 may first confirm, on the basis of the detection signal DET2, whether one or both of the relay 131 of the relay circuit 130 and the relay 331 of the relay circuit 330 are short-circuited (step S401).

When one or both of the relay 131 of the relay circuit 130 and the relay 331 of the relay circuit 330 are short-circuited in step S401 (step S401: Y), the controller 80 may stop an apparatus operation of the image forming apparatus 4 (step S402), and the display unit 53 may perform display indicating occurrence of an error (step S403). This may bring the flow to the end.

When none of the relay 131 of the relay circuit 130 and the relay 331 of the relay circuit 330 is short-circuited in step S401 (step S401: N), the heater controller 87 may turn on both of the relay 131 of the relay circuit 130 and the relay 331 of the relay circuit 330 by causing the relay control signal CTRL2 to be at the high level (step S411).

Thereafter, the heater controller 87 may confirm, on the basis of the detection signal DET1, whether one or both of the triac 115 of the triac circuit 110A and the triac 115 of the triac circuit 110B are malfunctioning (step S412).

When one or both of the triac 115 of the triac circuit 110A and the triac 115 of the triac circuit 110B are malfunctioning in step S412 (step S412: Y), the heater controller 87 may turn off both of the relay 131 of the relay circuit 130 and the relay 331 of the relay circuit 330 by causing the relay control signal CTRL2 to be at the low level (step S413). Thereafter, the flow may proceed to step S402.

When none of the triac 115 of the triac circuit 110A and the triac 115 of the triac circuit 110B is malfunctioning in step S412 (step S412: N), the heater controller 87 may turn on the triac 115 of each of the triac circuits 110A and 110B through the phase control (step S421), and the warm-up operation may be thereby performed (step S422).

Thereafter, the controller 80 may confirm whether the communicator 51 receives the print data DP in a period having a predetermined length (step S423). When the communicator 51 receives the print data DP in the period having the predetermined length (step S423: Y), the image forming apparatus 4 may perform the image forming operation on the basis of the received print data DP (step S424). Thereafter, the flow may proceed to step S431.

When the communicator 51 receives no print data DP in the period having the predetermined length in step S423 (step S423: N), a transition may be made to a standby mode (step S431). Thereafter, the heater controller 87 may turn off both of the triacs 115 of the respective triac circuits 110A and 110B, by causing both of the triac control signals CTRL1A and CTRL1B to be at the low level (step S432).

Thereafter, the heater controller 87 may confirm, on the basis of the detection signal DET1, whether one or both of the triac 115 of the triac circuit 110A and the triac 115 of the triac circuit 110B are malfunctioning (step S433).

When one or both of the triac 115 of the triac circuit 110A and the triac 115 of the triac circuit 110B are malfunctioning in step S433 (step S433: Y), the heater controller 87 may turn off both of the relay 131 of the relay circuit 130 and the relay 331 of the relay circuit 330 by causing the relay control signal CTRL2 to be at the low level (step S434). Thereafter, the flow may proceed to step S402.

When none of the triac 115 of the triac circuit 110A and the triac 115 of the triac circuit 110B is malfunctioning in step S433 (step S433: N), the heater controller 87 may turn off both of the relay 131 of the relay circuit 130 and the relay 331 of the relay circuit 330 by causing the relay control signal CTRL2 to be at the low level (step S441).

Thereafter, the heater controller 87 may confirm, on the basis of the detection signal DET2, whether one or both of the relay 131 of the relay circuit 130 and the relay 331 of the relay circuit 330 are short-circuited (step S442). When one or both of the relay 131 of the relay circuit 130 and the relay 331 of the relay circuit 330 are short-circuited (step S442: Y), the flow may proceed to step S402.

When none of the relay 131 of the relay circuit 130 and the relay 331 of the relay circuit 330 is short-circuited in step S442 (step S442: N), the flow may be brought to the end. When the communicator 51 receives the print data DP after the foregoing process is brought to the end, the operation may be started again from step S401.

According to the fourth example embodiment, the short-circuit detection circuit may generate the zero-crossing signal on the basis of the power supply signal. It is therefore possible to achieve a simple circuit configuration. Effects other than the foregoing effect may be similar to those of any of the first to third example embodiments described above.

[Other Modification Examples]

Moreover, any of the modification examples of the first to third example embodiments described above may be also applied to the image forming apparatus 4 according to the fourth example embodiment described above. Moreover, combination of two or more of the modification examples described above may be applied.

The technology has been described above referring to the example embodiments and the modification examples thereof. However, the technology is not limited to the example embodiments and the modification examples described above, and is modifiable in various ways.

For example, although the fixing unit 40 may be provided with the two heaters 42A and 42B according to any of the example embodiments and the modification examples described above, the number of the heater is not limited thereto. In one example, a single heater may be provided. In another example, three or more heaters may be provided.

Moreover, although a color image may be formed on the recording medium 9 according to any of the example embodiments and the modification examples described above, the image to be formed on the recording medium 9 is not limited thereto. In one example, a monochrome image may be formed.

Furthermore, the technology encompasses any possible combination of some or all of the various embodiments and the modifications described herein and incorporated herein.

It is possible to achieve at least the following configurations from the above-described example embodiments of the technology.

(1)

An image forming apparatus including:

an image forming unit that forms a developer image;

a first power terminal and a second power terminal both coupled to a power supply;

a fixing unit that includes a heater and fixes the developer image to a recording medium, the heater being provided in a power supply path that couples the first power terminal and the second power terminal to each other;

a first switch that includes a triac and is provided in the power supply path, the first switch being turned on and off on the basis of a first control signal;

a first detector that generates a first detection signal, the first detection signal corresponding to the turning on and off of the first switch, a second switch that includes a relay and is provided in the power supply path, the second switch being turned on and off on the basis of a second control signal; and a controller that generates the first control signal, and generates, on the basis of the first detection signal, the second control signal.

(2)

The image forming apparatus according to (2), in which the controller turns off, on the basis of the first detection signal, the second switch by the second control signal, when the controller controls the second switch to be turned on and controls the first switch to be turned off.

(3)

The image forming apparatus according to (1) or (2), in which the first switch, the heater, and the second switch are provided in this order in the power supply path, the first switch is coupled to the first power terminal, and the first detector is inserted between a first path and the second power terminal, the first path being a path, in the power supply path, between the first switch and the heater.

(4)

The image forming apparatus according to any one of (1) to (3), further including a synchronization signal generator that is able to generate a synchronization signal, the synchronization signal being synchronized with a power supply signal supplied from the power supply, in which the first switch, the heater, and the second switch are provided in this order in the power supply path, the second switch is coupled to the second power terminal, and the synchronization signal generator is inserted between the first power terminal and a second path, the second path being a path, in the power supply path, between the heater and the second switch.

(5)

The image forming apparatus according to any one of (1) to (4), further including a second detector that generates a second detection signal, the second detection signal corresponding to the turning on and off of the second switch, in which the first switch, the heater, and the second switch are provided in this order in the power supply path, the second switch is coupled to the second power terminal, and the second detector is inserted between the first power terminal and a second path, the second path being a path, in the power supply path, between the heater and the second switch.

(6)

The image forming apparatus according to any one of (1) to (3), further including a third switch that includes a relay and is provided in the power supply path, the third switch being turned on and off on the basis of a third control signal, in which the third switch, the first switch, the heater, and the second switch are provided in this order in the power supply path.

(7)

The image forming apparatus according to claim 6, further including a synchronization signal generator that is able to generate a synchronization signal, the synchronization signal being synchronized with a power supply signal supplied from the power supply, the synchronization signal generator being inserted between a second path and a third path, the second path being a path, in the power supply path, between the heater and the second switch, the third path being a path, in the power supply path, between the third switch and the first switch.

(8)

The image forming apparatus according to (6) or (7), further including a second detector that generates a second detection signal, the second detection signal corresponding to the turning on and off of one or both of the second switch and the third switch, the second detector being inserted between a second path and a third path, the second path being a path, in the power supply path, between the heater and the second switch, the third path being a path, in the power supply path, between the third switch and the first switch.

(9)

The image forming apparatus according to (6), further including a third detector that generates a signal and outputs the generated signal as a third detection signal, the third detector, when both of the second switch and the third switch are turned on, generating a synchronization signal and outputting the generated synchronization signal as the third detection signal, the signal corresponding to the turning on and off of one or both of the second switch and the third switch, the synchronization signal being synchronized with a power supply signal supplied from the power supply, in which the first switch is coupled to the first power terminal, the second switch is coupled to the second power terminal, and the third detector is coupled to each of the first power terminal, the second power terminal, a second path, and a third path, the second path being a path, in the power supply path, between the heater and the second switch, the third path being a path, in the power supply path, between the third switch and the first switch.

(10)

The image forming apparatus according to any one of (1) to (9), in which the first detection signal includes, when the first switch is turned on, a pulse having a time width corresponding to a half-wave of a power supply signal supplied from the power supply.

According to the image forming apparatus of one embodiment of the technology, the first detector that generates the first detection signal corresponding to the turning on and off of the first switch is provided. Hence, it is possible to suppress an influence of a malfunction of the triac.

Figure 11:
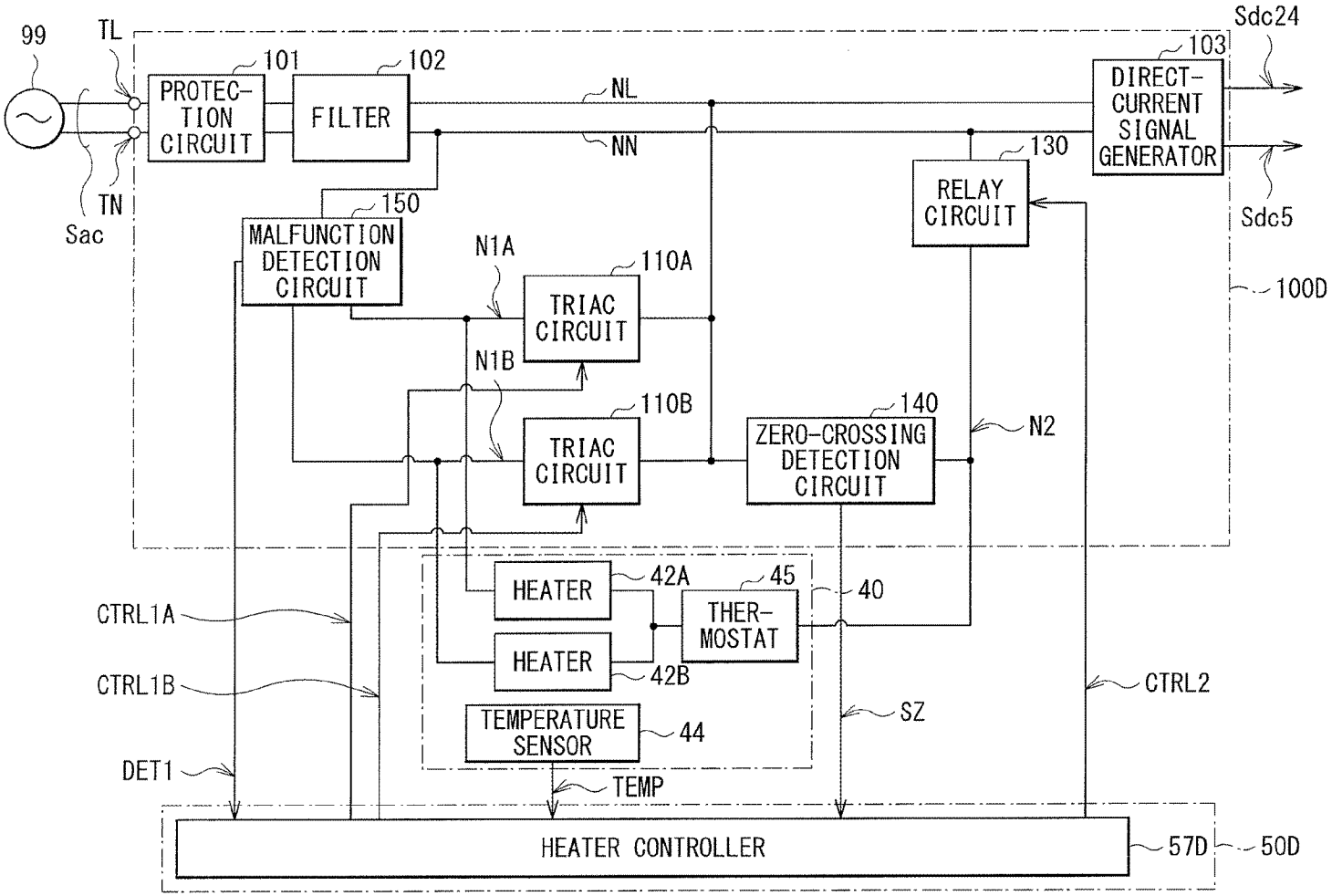
FIG. 11 is a block diagram illustrating an example of a configuration of a power supply unit according to still another modification example of one example embodiment.
Figure 12:
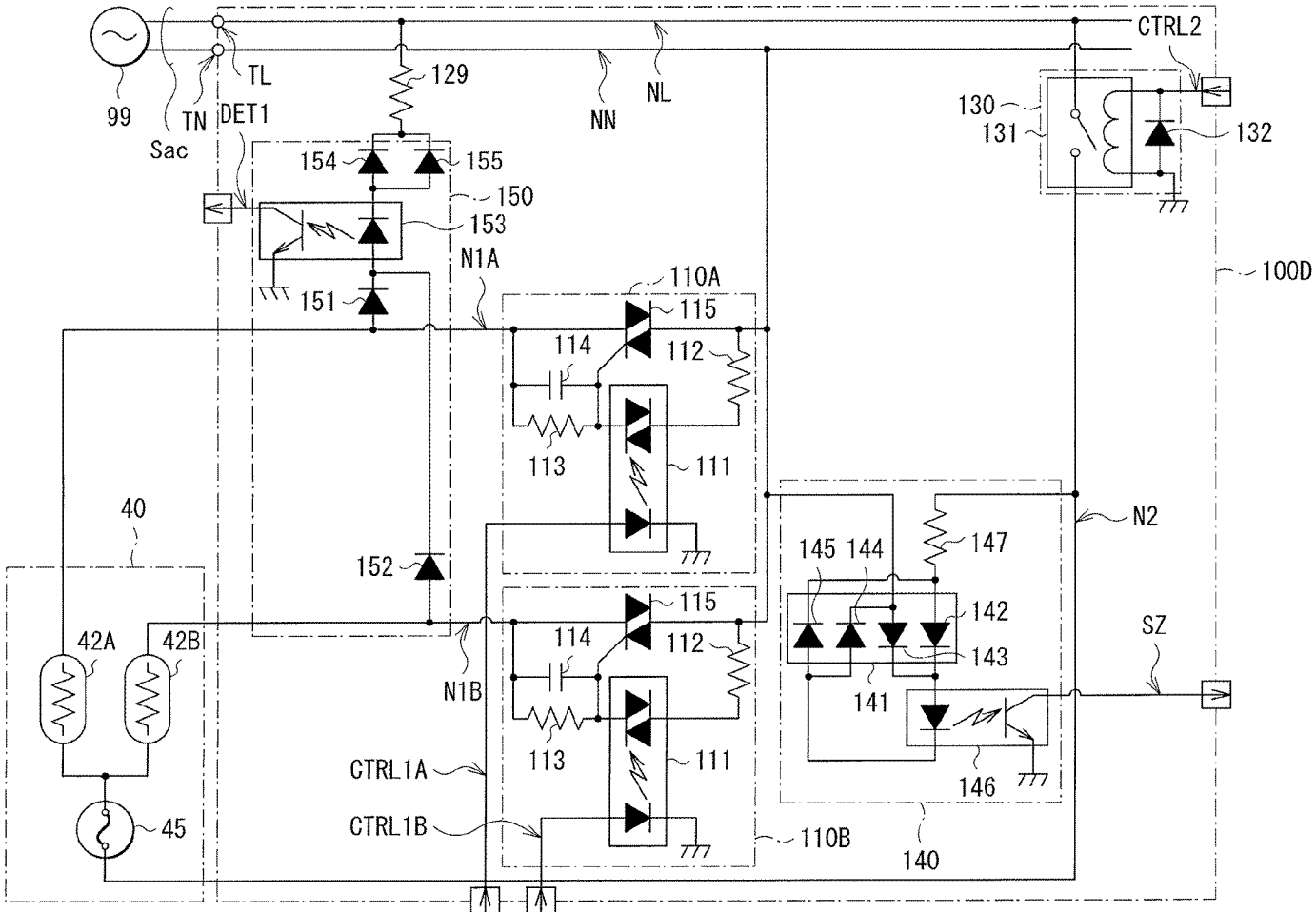
FIG. 12 is a circuit diagram illustrating an example of a configuration of the power supply unit illustrated in FIG. 11.

Each of the heater controller 57 illustrated in FIG. 2, the heater controller 57D illustrated in FIG. 11, the heater controller 67 illustrated in FIG. 13, the heater controller 77 illustrated in FIG. 19, and the heater controller 87 illustrated in FIG. 22 is implementable by circuitry that includes at least one of a field programmable gate array (FPGA), a semiconductor integrated circuit, and an application specific integrated circuit (ASIC). The FPGA is an integrated circuit (IC) designed to be configured after manufacturing in order to perform all or a part of the functions of each of the heater controller 57 illustrated in FIG. 2, the heater controller 57D illustrated in FIG. 11, the heater controller 67 illustrated in FIG. 13, the heater controller 77 illustrated in FIG. 19, and the heater controller 87 illustrated in FIG. 22. The ASIC is an IC customized to perform all or a part of the functions of each of the heater controller 57 illustrated in FIG. 2, the heater controller 57D illustrated in FIG. 11, the heater controller 67 illustrated in FIG. 13, the heater controller 77 illustrated in FIG. 19, and the heater controller 87 illustrated in FIG. 22. The semiconductor integrated circuit may be, for example, at least one processor such as a central processing unit (CPU). The processor may be configurable to read instructions from at least one machine readable tangible non-transitory medium to thereby perform all or a part of functions of each of the heater controller 57 illustrated in FIG. 2, the heater controller 57D illustrated in FIG. 11, the heater controller 67 illustrated in FIG. 13, the heater controller 77 illustrated in FIG. 19, and the heater controller 87 illustrated in FIG. 22. The form of such a medium may include, for example, any type of magnetic medium, any type of optical medium, or any type of semiconductor memory (i.e., semiconductor circuit). The magnetic medium may be a hard disk, for example. The optical medium may be a CD or a DVD, for example. The semiconductor memory may be a volatile memory or a non-volatile memory, for example. The volatile memory may include a DRAM or a SRAM, for example. The nonvolatile memory may include a ROM or a NVRAM, for example.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

an image forming unit that forms a developer image;

a first power terminal and a second power terminal both coupled to a power supply;

a fixing unit that includes a heater and fixes the developer image to a recording medium, the heater being provided in a power supply path that couples the first power terminal and the second power terminal to each other;

a first switch that includes a triac and is provided in the power supply path, the first switch being turned on and off on a basis of a first control signal;

a first detector that generates a first detection signal, the first detection signal corresponding to the turning on and off of the first switch;

a second switch that includes a relay and is provided in the power supply path, the second switch being turned on and off on a basis of a second control signal;

a synchronization signal generator that is able to generate a synchronization signal, the synchronization signal being synchronized with a power supply signal supplied from the power supply; and a controller that generates the first control signal, and generates, on a basis of the first detection signal, the second control signal, wherein the first switch, the heater, and the second switch are provided in this order in the power supply path, the second switch is coupled to the second power terminal, and the synchronization signal generator is inserted between the first power terminal and a second path, the second path being a path, in the power supply path, between the heater and the second switch.

2. The image forming apparatus according to claim 1, wherein the controller turns off, on the basis of the first detection signal, the second switch by the second control signal, when the controller controls the second switch to be turned on and controls the first switch to be turned off.

3. The image forming apparatus according to claim 1, wherein the first switch is coupled to the first power terminal, and the first detector is inserted between a first path and the second power terminal, the first path being a path, in the power supply path, between the first switch and the heater.

4. The image forming apparatus according to claim 1, wherein the first detection signal includes, when the first switch is turned on, a pulse having a time width corresponding to a half-wave of the power supply signal supplied from the power supply.

5. An image forming apparatus comprising:

an image forming unit that forms a developer image;

a first power terminal and a second power terminal both coupled to a power supply;

a fixing unit that includes a heater and fixes the developer image to a recording medium, the heater being provided in a power supply path that couples the first power terminal and the second power terminal to each other;

a first switch that includes a triac and is provided in the power supply path, the first switch being turned on and off on a basis of a first control signal;

a first detector that generates a first detection signal, the first detection signal corresponding to the turning on and off of the first switch;

a second switch that includes a relay and is provided in the power supply path, the second switch being turned on and off on a basis of a second control signal;

a second detector that generates a second detection signal, the second detection signal corresponding to the turning on and off of the second switch; and a controller that generates the first control signal, and generates, on a basis of the first detection signal, the second control signal, wherein the first switch, the heater, and the second switch are provided in this order in the power supply path, the second switch is coupled to the second power terminal, and the second detector is inserted between the first power terminal and a second path, the second path being a path, in the power supply path, between the heater and the second switch.

6. The image forming apparatus according to claim 5, wherein the controller turns off, on the basis of the first detection signal, the second switch by the second control signal, when the controller controls the second switch to be turned on and controls the first switch to be turned off.

7. The image forming apparatus according to claim 5, wherein the first switch is coupled to the first power terminal, and the first detector is inserted between a first path and the second power terminal, the first path being a path, in the power supply path, between the first switch and the heater.

8. The image forming apparatus according to claim 5, further comprising a synchronization signal generator that is able to generate a synchronization signal, the synchronization signal being synchronized with a power supply signal supplied from the power supply, wherein the synchronization signal generator is inserted between the first power terminal and a second path, the second path being a path, in the power supply path, between the heater and the second switch.

9. The image forming apparatus according to claim 5, wherein the first detection signal includes, when the first switch is turned on, a pulse having a time width corresponding to a half-wave of a power supply signal supplied from the power supply.

10. An image forming apparatus comprising:

an image forming unit that forms a developer image;

a first power terminal and a second power terminal both coupled to a power supply;

a fixing unit that includes a heater and fixes the developer image to a recording medium, the heater being provided in a power supply path that couples the first power terminal and the second power terminal to each other;

a first switch that includes a triac and is provided in the power supply path, the first switch being turned on and off on a basis of a first control signal;

a first detector that generates a first detection signal, the first detection signal corresponding to the turning on and off of the first switch;

a second switch that includes a relay and is provided in the power supply path, the second switch being turned on and off on a basis of a second control signal;

a third switch that includes a relay and is provided in the power supply path, the third switch being turned on and off on a basis of a third control signal; and a controller that generates the first control signal, and generates, on a basis of the first detection signal, the second control signal, wherein the third switch, the first switch, the heater, and the second switch are provided in this order in the power supply path.

11. The image forming apparatus according to claim 10, wherein the controller turns off, on the basis of the first detection signal, the second switch by the second control signal, when the controller controls the second switch to be turned on and controls the first switch to be turned off.

12. The image forming apparatus according to claim 10, wherein the third switch is coupled to the first power terminal, and the first detector is inserted between a first path and the second power terminal, the first path being a path, in the power supply path, between the first switch and the heater.

13. The image forming apparatus according to claim 10, further comprising a synchronization signal generator that is able to generate a synchronization signal, the synchronization signal being synchronized with a power supply signal supplied from the power supply, the synchronization signal generator being inserted between a second path and a third path, the second path being a path, in the power supply path, between the heater and the second switch, the third path being a path, in the power supply path, between the third switch and the first switch.

14. The image forming apparatus according to claim 10, further comprising a second detector that generates a second detection signal, the second detection signal corresponding to the turning on and off of one or both of the second switch and the third switch, the second detector being inserted between a second path and a third path, the second path being a path, in the power supply path, between the heater and the second switch, the third path being a path, in the power supply path, between the third switch and the first switch.

15. The image forming apparatus according to claim 10, further comprising a third detector that generates a signal and outputs the generated signal as a third detection signal, the third detector, when both of the second switch and the third switch are turned on, generating a synchronization signal and outputting the generated synchronization signal as the third detection signal, the signal corresponding to the turning on and off of one or both of the second switch and the third switch, the synchronization signal being synchronized with a power supply signal supplied from the power supply, wherein the first switch is coupled to the first power terminal, the second switch is coupled to the second power terminal, and the third detector is coupled to each of the first power terminal, the second power terminal, a second path, and a third path, the second path being a path, in the power supply path, between the heater and the second switch, the third path being a path, in the power supply path, between the third switch and the first switch.

16. The image forming apparatus according to claim 10, wherein the first detection signal includes, when the first switch is turned on, a pulse having a time width corresponding to a half-wave of a power supply signal supplied from the power supply.

* * * * *